US008652737B2

(12) United States Patent
Handa et al.

(10) Patent No.: US 8,652,737 B2
(45) Date of Patent: Feb. 18, 2014

(54) TONER AND IMAGE FORMING PROCESS

(75) Inventors: Satoshi Handa, Saitama (JP); Naoya Isono, Susono (JP); Katsuyuki Nonaka, Mishima (JP); Koji Abe, Numazu (JP); Yasuhiro Hashimoto, Mishima (JP); Akira Sugiyama, Mishima (JP); Yuhei Terui, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 425 days.

(21) Appl. No.: 12/266,136

(22) Filed: Nov. 6, 2008

(65) Prior Publication Data

US 2009/0130582 A1 May 21, 2009

(30) Foreign Application Priority Data

Nov. 8, 2007 (JP) ..... 2007-290732
Sep. 2, 2008 (JP) ..... 2008-224651

(51) Int. Cl.
*G03G 13/08* (2006.01)
*G03G 9/00* (2006.01)

(52) U.S. Cl.
USPC ..... 430/123.51; 430/108.3; 430/124.1; 430/135.15

(58) Field of Classification Search
USPC ..... 430/108.3, 124.1, 137.15, 123.51
See application file for complete search history.

(56) References Cited

U.S. PATENT DOCUMENTS 5,191,098 A * 3/1993 Koenig et al. ..... 554/156
5,308,734 A 5/1994 Sacripante et al. ..... 430/137.14
5,439,773 A 8/1995 Matsui et al.
6,160,142 A 12/2000 Sawada et al. ..... 554/158
6,495,303 B1 * 12/2002 Kanda et al. ..... 430/137.17
7,112,393 B2 9/2006 Komoto et al. ..... 430/108.5
7,452,645 B2 11/2008 Sugiura
7,485,400 B2 2/2009 Veregin et al.
2001/0046636 A1 * 11/2001 Daimon et al. ..... 430/109.4
2004/0126691 A1 7/2004 Tsutsui et al. ..... 430/108.4
2006/0051696 A1 * 3/2006 Tsutsui et al. ..... 430/125

FOREIGN PATENT DOCUMENTS

EP 1 548 510 A2 6/2005
EP 1 843 213 A2 10/2007
JP 6-175393 A 6/1994
JP 08-129304 5/1996
JP 09-311499 12/1997
JP 10-026896 1/1998
JP 3055119 6/2000

(Continued)

OTHER PUBLICATIONS

Search Report for EP 08168478 dated Feb. 2, 2009.

(Continued)

*Primary Examiner* — Thorl Chea
(74) *Attorney, Agent, or Firm* — Fitzpatrick, Cella, Harper and Scinto

(57) ABSTRACT

A toner which has i) toner base particles containing at least a binder resin and a colorant and ii) a fatty acid metal salt composition as an external additive. The fatty acid metal salt composition contains a nonionic surface-active agent and a fatty acid metal salt. This toner and an image forming process making use of the toner can keep the toner from adhering to a toner carrying member throughout running, promise a stable chargeability of the toner and can keep any deterioration of halftone image quality from being caused by excess charging of the toner and any image fog from being caused by insufficient charging of the toner.

15 Claims, 3 Drawing Sheets

(56) References Cited

FOREIGN PATENT DOCUMENTS

| | | | |
|---|---|---|---|
| JP | 2002-014488 | | 1/2002 |
| JP | 2002-296829 | | 10/2002 |
| JP | 2004-163807 | | 6/2004 |
| JP | 2006-017934 | | 1/2006 |
| JP | 2006-30653 | A | 2/2006 |
| JP | 2007-108622 | * | 4/2007 |
| JP | 2007-279726 | A | 10/2007 |

OTHER PUBLICATIONS

Official Action dated Dec. 8, 2010 in Korean Application No. 10-2008-0110205.

Korean Office Action dated Apr. 3, 2012 in Korean Application No. 10-2008-0110205.

* cited by examiner

TONER AND IMAGE FORMING PROCESS

BACKGROUND OF THE INVENTION

1. Field of the Invention

This invention relates to a toner used in an image forming process that utilizes electrophotography or electrostatic recording. More particularly, it relates to an image forming process making use of a toner having i) toner base particles containing a binder resin, a colorant and a release agent and ii) an external additive powder.

2. Description of the Related Art

A developing process used in electrophotographic apparatus or the like is a process in which a toner is made to adhere to an electrostatic latent image formed on an electrostatic latent image bearing member to render the electrostatic latent image visible to form a toner image, which is then transferred to a recording medium, followed by a fixing step to obtain a fixed image.

As developers used in electrophotography, they are grouped into a one-component developer and a two-component developer. They are also grouped into magnetic and non-magnetic, in respect of toners.

The toner of the present invention may be used in either developer of the both.

In recent years, in electrophotographic systems, a one-component developing system has come into wide use. In such a system, the toner is electrostatically charged by rubbing friction between a toner carrying member and a toner layer thickness control member. Employment of such a system of charging the toner electrostatically has made it easy to succeed in making printers low-price and compact. With a demand for color image formation in recent years, a non-magnetic one-component developing system has also come into wide use, which is advantageous to printers being made low-price and compact.

In respect of making the toner stably chargeable, the two-component developer is advantageous. Accordingly, both the one-component and two-component developers and developing systems are employed in electrophotography.

Meanwhile, as printers are being made low-price and compact, it is also sought to make total powder consumption small. In particular, in the fixing step, it is sought to lessen the energy to be consumed. For this end, it is necessary to make a toner more advanced which is fixable at a lower temperature.

As the toner is thus being made fixable at a lower temperature, the toner shows a tendency to have a poor durability to mechanical stress. This is considered due to the fact that giving preference to the fixing performance of toner in order to make a toner adaptable to more low-temperature fixing makes the toner have poor properties to mechanical stress in the range of service temperature set usually.

Further, there is in the market a high demand for printers to be made more high-speed. Problems on printing at a high speed are not only a demand for the above low-temperature fixing performance but also a demand for much higher resistance to stress. In general, high-speed machines have a fast mechanical movement in the apparatus. Hence, heat tends to be generated at their shafts of rollers or the like and rubbing portions. In particular, in the one-component developing system, in which the toner is electrostatically charged by the rubbing friction between a toner carrying member and a toner layer thickness control member, it is demanded at a technically high level to balance the demand for toner and the durability of toner that come as printers are made high-speed.

In order to meet such demands at a high level, toners produced by polymerization, toners obtained by making pulverization toners spherical by heat, toners obtained by agglomerating emulsification particles, and so forth are proposed as toner particles.

Many of such toners are those designed to have a higher mechanical strength than any conventional toners of a melt-kneading and pulverization type. For example, resins that compose toner particle surfaces and toner particle interiors are compositionally changed to provide toner particles with a core-shell structure. With such a structure, a toner is proposed in which a material having a high mechanical strength is used in the shell and a material effective in fixing is used in the core (see, e.g., Japanese Patent No. 3055119).

However, even with use of such a toner, faulty toner transport accompanied by a phenomenon that the surface of a toner transport member is contaminated with toner (i.e., toner melt adhesion to a toner carrying member) tends to occur in the non-magnetic one-component developing system having a high process speed.

As a result of examination of such toner melt adhesion to a toner carrying member, it is considered to be caused by particles having small particle size (a fine-powder component) in toner which do not participate in development and are accumulated on the toner carrying member surface to become thickened thereon during running (extensive operation). In order to lessen such option of particles in the toner during running, it is important to make the toner highly releasable from the toner carrying member surface and to make the toner stably chargeable.

Such a toner also tends to bring about problems such as any image fog and any line image development (development lines) which is caused by restriction due to adhesion of a toner to the toner layer thickness control member.

It is preferable that the toner improved in mechanical strength as stated above is used in such a non-magnetic one-component developing image forming apparatus having a high process speed. However, anything has not been obtained which can meet demands for further energy saving and higher speed.

Meanwhile, in regard to improvement in running performance of toners, various surface treating agents (external additives) have been proposed.

Of these proposals, it has been invented to use a fatty acid metal salt as an external additive of toner base particles.

For example, a toner is disclosed which is composed of negatively chargeable toner base particles and a fatty acid metal salt (see, e.g., Japanese Patent Application Laid-open Nos. H08-129304 and 2002-014488).

A toner is also disclosed which contains a fatty acid metal salt having a specific volume average particle diameter (see, e.g., Japanese Patent Application Laid-open Nos. 2004-163807 and 2002-296829).

A toner is still also disclosed which has specified the circularity of a toner containing a fatty acid metal salt and the ratio of particle diameters of the fatty acid metal salt (see, e.g., Japanese Patent Application Laid-open No. 2006-017934).

Toners making use of these external additives are effective in improving blade cleaning performance, in improving blade turn-up resistance and in keeping the electrostatic latent image bearing member surface from abrading. They may also be effective in achieving uniform chargeability and in keeping drum filming from occurring.

Such toners show superior lubricity on the electrostatic latent image bearing member surface. However, the fatty acid metal salt tends to be selectively consumed during running, so that the toners may come less effective in keeping such lubricity at the latter half of running. In addition, in order for the toners to be effective as stated above, the fatty acid metal salt must be added in a sufficient quantity, but this tends to bring about problems such as charging-part contamination under the influence of any excess fatty acid metal salt. Further, such a problem tends to be a remarkable problem in color toners used in image forming apparatus of a high-speed type, and hence, when used in the apparatus of a high-speed type, it is necessary to keep use of a sufficiently effective material in a proper quantity.

Invention has also been made on a toner, taking note of the relationship between its number average particle diameter, the proportion of 3.17 μm or smaller particles and the number average particle diameter of a fatty acid metal salt.

According to such invention, a toner can be obtained which may less wear a photosensitive member, can be free of any image fog or blurred images, can form uniform halftone images and also may less cause toner spots around minute dots (see, e.g., Japanese Patent No. 3467966).

A toner is further disclosed which is a one-component developer containing toner base particles having a melt viscosity within a specific range, a fluidity improver and a fatty acid metal salt, and has specified the relationship between toner particle diameter and fatty acid metal salt particle diameter. According to this, a toner is obtained which promises a high image density, may less cause fog and can provide a superior sharpness (see, e.g., Japanese Patent Application Laid-open No. H09-311499).

The toner as noted above may less cause fog and enables reproduction of minute images. However, further improvement is necessary for its application to the non-magnetic one-component developing image forming apparatus having a high process speed. Such invention has not succeeded in achievement of any sufficient performance.

Thus, the techniques conventionally available as stated above have some subjects to be settled for high demands made at present.

Meanwhile, as typical methods presently available for producing the fatty acid metal salt may include a method in which a solution of an inorganic metal compound is dropwise added to a solution of an alkali metal salt of a fatty acid to carry out reaction (a double decomposition process), and a method in which a fatty acid and an inorganic metal compound are kneaded at a high temperature to carry out reaction (a melting process).

Further, various studies are made on how the fatty acid metal salt be made finer. For example, invention has been made on a production method by which the fatty acid metal salt is made into fine particles, and on a toner making use of such particles (see, e.g., Japanese Patent No. 3906580).

Such a toner is one in which the fatty acid metal salt is made finer by controlling solvent concentration and temperature at the time of synthesis when it is produced by a wet process. The toner containing such a fatty acid metal salt well brings out the performance as a lubricant at least and can be highly effective as a cleaning aid.

SUMMARY OF THE INVENTION

Conventional fatty acid metal salts are not sufficiently effective in preventing the toner from adhering to the toner carrying member surface, thus there has still been room for improvement. In addition, in the toner containing a fatty acid metal salt, it can provide images having a high density, less fog and a superior sharpness, but has a problem on the high-level demands made in high-speed color image forming machines having a high process speed.

Accordingly, the present inventors have made extensive studies. As the result, they have discovered that a fatty acid metal salt containing a specific compound may be added as an external additive to toner base particles and this can overcome the above problems, thus they have accomplished the present invention.

A first object of the present invention is to provide a toner which can keep itself from adhering to the toner carrying member throughout running, and an image forming process making use of the toner.

A second object of the present invention is to provide a toner which can keep its chargeability within a proper range throughout running and may very less cause any deterioration of halftone image quality that is due to excess charging of the toner and any image fog that is due to insufficient charging of the toner, and an image forming process making use of the toner.

A third object of the present invention is to provide a toner which may less cause throughout running any contamination of a primary charging member that may be caused by transfer residual toner on the electrostatic latent image bearing member, and an image forming process making use of the toner.

The above objects can be achieved by the present invention described below.

That is, the present invention is a toner which comprises i) toner base particles having at least a binder resin and a colorant and ii) a fatty acid metal salt composition as an external additive; the fatty acid metal salt composition containing a nonionic surface-active agent and a fatty acid metal salt.

The use of the toner of the present invention enables the toner to be improved in releasability from the toner carrying member surface, and also enables any problem to be very less caused, such as the thickening of fine powder on the toner carrying member surface. As the result, stable toner particle size can be kept throughout running, and the toner can be kept from melt-adhering (toner filming) to the toner carrying member.

The use of the toner of the present invention also enables the toner to have chargeability within a proper range throughout running. As the result, images can be formed which are very much free of any halftone image non-uniformity that is due to excess charging of the toner and any image fog that is due to insufficient charging of the toner.

Further, the use of the toner of the present invention enables the charging member to be kept from being contaminated because of external additives contained in transfer residual toner on the electrostatic latent image bearing member. As the result, any faulty primary charging of the electrostatic latent image bearing member and any halftone image non-uniformity may very less occur during running, and stable images can be formed throughout running.

Further features of the present invention will become apparent from the following description of exemplary embodiments with reference to the attached drawings.

DESCRIPTION OF THE EMBODIMENTS

Figure 1:
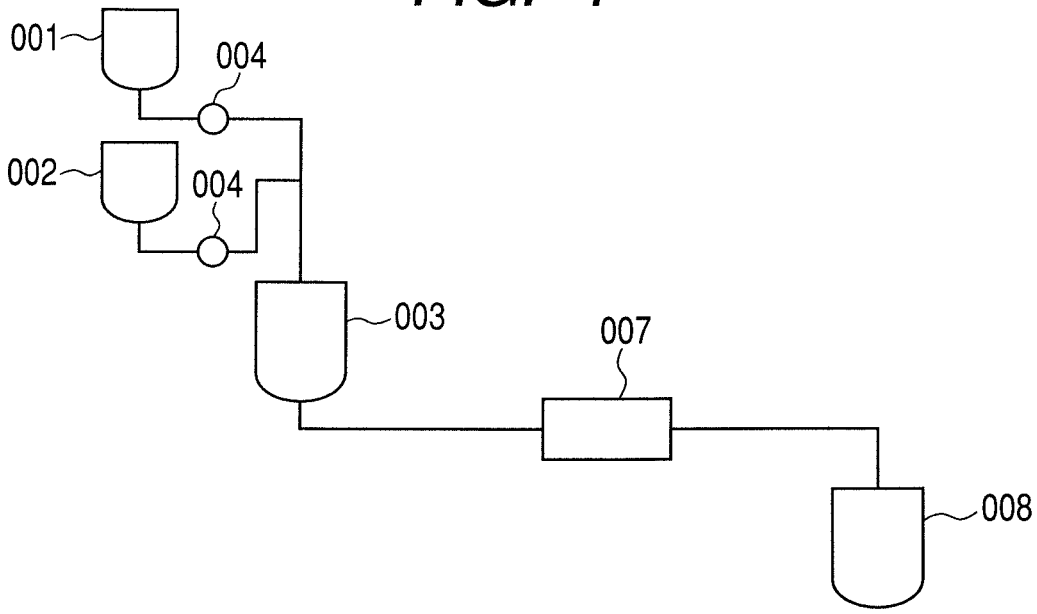
FIG. 1 is a schematic view of a continuous reaction system usable in synthesizing the fatty acid metal salt composition.

In the present invention, a fatty acid metal salt composition containing a nonionic surface-active agent is added as an external additive to toner base particles. This enables improvement in releasability of the toner and enables the toner to be kept from melt-adhering (toner filming) to the toner carrying member. In addition, because of its superior releasability, the fine power having a relatively small particle diameter can be kept from stagnating on the toner carrying member surface, and this makes stable particle size distribution maintainable throughout running.

Further, inasmuch as the fatty acid metal salt composition containing a nonionic surface-active agent is added as an external additive to toner base particles, the toner can be improved in its charging stability and the charge quantity can be maintained within an appropriate rage throughout running. Hence, this can well keep any halftone image non-uniformity and image fog from occurring.

What constitutes the present invention also enables the charging member to be kept from being contaminated because of external additives contained in transfer residual toner on the electrostatic latent image bearing member, and hence any faulty primary charging of the electrostatic latent image bearing member and any halftone image non-uniformity may very less occur during running, and stable images can be formed throughout running.

The fatty acid metal salt composition containing a nonionic surface-active agent, which is favorably used in the present invention, is described below.

First, the nonionic surface-active agent is specifically described below on its examples.

The nonionic surface-active agent is a generic term of substances belonging to, stated specifically, nonionic surface-active agents grouped by what is prescribed as sundry industrial products quality indication according to the Ministry of Economy and Industries.

Besides, there are anionic, cationic and amphoteric surface-active agents. However, any of fatty acid metal salt compositions containing such ionic surface-active agents show a tendency to make the toner greatly undergo environmental changes in charge characteristics. Such materials that may greatly undergo environmental changes in charge characteristics tend to inhibit the charge characteristics of the toner to cause problems such as fog and toner leak in drops in an environment of high humidity. As a reason why such environmental changes in charge characteristics come about, it is presumed that water tends to come adsorbed to the polarized moiety of a fatty acid the fatty acid metal salt composition has, thus the charge can not be retained in part under the influence of the water adsorbed thereto. Studies made on cationic and anionic surface-active agents also have revealed that any fatty acid metal salt composition having preferable particle diameter and charge characteristics can not stably be formed and such surface-active agents are not suitable for their use in the fatty acid metal salt composition.

The nonionic surface-active agent is further grouped into a fatty acid type, a higher alcohol type and an alkylphenol type. Groups preferable as the surface-active agent to be contained in the fatty acid metal salt composition are higher alcohol type or alkylphenol type surface-active agents.

As the nonionic surface-active agent to be contained in the fatty acid metal salt composition, it may preferably be an ether-type surface-active agent, which may specifically include polyoxyethylene alkyl ethers such as polyoxyethylene lauryl ether, polyoxyethylene tridecyl ether, polyoxyethylene cetyl ether, polyoxyethylene stearyl ether, and polyoxyethylene oleyl ether; polyoxyethylene alkyl phenyl ethers such as polyoxyethylene nonyl phenyl ether, and polyoxyethylene octyl phenyl ether; and polyalkylene alkyl ethers.

Of these, preferred are lauryl alcohol ethylene oxide addition ether, oleyl alcohol ethylene oxide addition ether, and nonyl phenol alcohol ethylene oxide addition ether.

The nonionic surface-active agent in the fatty acid metal salt composition may preferably be in a content of from 10 ppm to 500 ppm, more preferably from 10 ppm to 400 ppm, and still more preferably from 15 ppm to 350 ppm, in the fatty acid metal salt composition.

Inasmuch as the nonionic surface-active agent is in a content of 10 ppm or more, the fatty acid metal salt composition can appropriately be charged and the developer can more evenly be consumed to enable formation of halftone images kept from any coarseness even at the latter part of running. In addition, the toner consumption proceeds speedily, and hence the toner can be kept from coming to melt-adhere to the toner carrying member surface and also any image fog and line images can be kept from occurring.

Inasmuch as the nonionic surface-active agent is in a content of 500 ppm or less, good charge characteristics can be maintained also in an environment of high humidity and any image fog can well be kept from occurring even as a result of long running or as a result of long leaving.

The fatty acid in the fatty acid metal salt composition may include monobasic saturated fatty acids such as butyric acid, valeric acid, lauric acid, myristic acid, palmitic acid, stearic acid and montanic acid; polybasic saturated fatty acids such as adipic acid, pimelic acid, suberic acid, azelaic acid and sebacic acid; monobasic unsaturated fatty acids such as crotonic acid and oleic acid; and polybasic unsaturated fatty acids such as maleic acid and citraconic acid.

Saturated or unsaturated fatty acids having 8 to 35 carbon atoms are preferred. In particular, they may preferably be acids composed chiefly of stearic acid.

Many of fatty acids present in nature are present in the form of a mixture of acid components having a different number of carbon atoms. To describe the fatty acid taking the case of stearic acid obtained as a natural product, it is one composed chiefly of stearic acid having 18 carbon atoms and further containing in a very small quantity a fatty acid component having, e.g., 14 carbon atoms, 16 carbon atoms, 20 carbon atoms or 22 carbon atoms. Usually, those subjected to a purification step to a certain extent so as to make the fatty acid component have a higher purity are industrially available. Further, as high-purity products, there are also Japanese pharmacopeia grade products, and the use of any of these is also preferable in order to obtain the effect. Where stearic acid is used as the fatty acid, the stearic acid may preferably have a purity of 90.0% by mass or more, and more preferably 95.0% by mass or more, of the whole.

Inasmuch as the stearic acid has a purity of 90.0% by mass or more, particles of a stearic acid metal salt can have especially good heat resistance, and this is preferable from the viewpoint of readiness in production and easiness in handling.

Here, the purity of the fatty acid is purity as that of the stearic acid component. Any fatty acids having carbon atoms other than 18 carbon atoms and the other organic matter and inorganic matter are regarded as impurities.

A chief metal species that forms the salt may be lithium, sodium, potassium, copper, rubidium, silver, zinc, magnesium, calcium, strontium, aluminum, iron, cobalt and nickel, any of which may be used. Further, in order to keep the chargeability of the toner within an appropriate range throughout running, it is preferable to use zinc or calcium.

Other metal species may also be incorporated together with the chief metal species. In this case, such other metal species may preferably be in an elementary proportion (proportion of other metal species held in the whole) of less than 30%.

What are most preferred as the fatty acid metal salt are zinc stearate and calcium stearate.

Preferable physical properties of the fatty acid metal salt composition are specifically described below.

In order to preferably bring out the effect of the present invention, the fatty acid metal salt composition may preferably have a volume-based median diameter (D50s) of from 0.15 μm or more to 1.05 μm or less, more preferably from 0.15 μm or more to 0.65 μm or less, and still more preferably from 0.30 μm or more to 0.60 μm or less.

Inasmuch as the fatty acid metal salt composition used in the toner of the present invention has a volume-based median diameter (D50s) of 0.15 μm or more, it may well act as a lubricant, and the effect of keeping the toner from melt-adhering to the toner carrying member can sufficiently be obtained. Where on the other hand the fatty acid metal salt composition has a volume-based median diameter (D50s) of 1.05 μm or less, the effect of the present invention can be especially remarkable. This is considered due to the fact that the fatty acid metal salt composition has particle diameter in a size suitable for it to adhere to the toner base particles and hence is highly adherent to the toner base particles. Where the fatty acid metal salt composition has a volume-based median diameter (D50s) of from 0.15 μm or more to 0.65 μm or less, its adhesion to the toner base particles and its action as a lubricant in virtue of the fatty acid metal salt can especially be well balanced, and this brings out the effect of the present invention very well. What may also contribute to this is the effect of keeping the toner from being charged in excess, which is brought by the nonionic surface-active agent present on the particle surfaces of the fatty acid metal salt composition, as so considered.

As thermal properties of the fatty acid metal salt composition, it may preferably have a melting point of from 122.0° C. or more to 130.0° C. or less when an endothermic peak temperature as analyzed by differential scanning calorimetry is set as the melting point.

Inasmuch as the fatty acid metal salt composition has a melting point within the above range, the controlling of agglomeration due to heat and the controlling of toner melt adhesion can be balanced, and also the toner can be more improved in its storage stability.

As a method by which the nonionic surface-active agent is incorporated in the fatty acid metal salt composition, there are no particular limitations thereon. What is easy and preferable is a method in which, as will be detailed later, the fatty acid metal salt is synthesized in water and in that water the nonionic surface-active agent is kept present as a dispersion stabilizer to allow it to be taken into the fatty acid metal salt. However, as mentioned above, the method is by no means limited to this. The nonionic surface-active agent may also be incorporated by treating the fatty acid metal salt after its formation.

A preferable method for producing the fatty acid metal salt composition is specifically described below.

Typical methods presently available for producing the fatty acid metal salt may include as examples thereof a method in which a solution of an inorganic metal compound is dropwise added to a solution of an alkali metal salt of the fatty acid to carry out reaction (a double decomposition process), and a method in which the fatty acid and an inorganic metal compound are kneaded at a high temperature to carry out reaction (a melting process).

The fatty acid metal salt composition used in the present invention contains the nonionic surface-active agent. A production process that is preferable in order for the surface-active agent to be incorporated in the state it is less uneven between particles of the fatty acid metal salt composition is a wet process. In particular, the double decomposition process is preferred.

This process has a production step the step of dropwise adding a solution of an inorganic metal compound to a solution of an alkali metal salt of the fatty acid to substitute the alkali metal salt of the fatty acid with the metal of the inorganic metal compound.

Note, however, that carrying out synthesis by a commonly available double decomposition process shows a tendency that a fatty acid metal salt composition may be made which has an average particle diameter of more than 7.0 μm and also contains about 20% by mass or more of particles having particle diameters of 10 μm or more.

Where a fatty acid metal salt made into fine particles should be produced, a substance having the action of dispersion stabilization may be added to an aqueous system when synthesized in an aqueous medium, to change the interfacial energy between the fatty acid metal salt composition to be formed and the dispersion medium. A means for changing such interfacial energy may include a method making use of a surface-active agent.

As the surface-active agent achievable of such action, it is particularly preferable to use a nonionic surface-active agent. What has previously been described may be used as the nonionic surface-active agent.

In regard to the surface-active agent, the HLB value that is a numerical representation of hydrophilic-lipophilic balance has been proposed and widely used in various fields.

Then, the present inventors have studied various surface-active agents in respect of the surface-active agent used when the fatty acid metal salt composition is synthesized, to find that there are the types of surface-active agents and groups of HLB values that enable effective formation of the fatty acid metal salt composition.

The HLB value that is preferable in order to make the fatty acid metal salt composition stably dispersible is from 5.0 to 15.0.

Nonionic surface-active agents that satisfy preferable HLB values are obtainable by controlling an alcohol component and an ethylene oxide addition component in each surface-active agent. Stated more specifically, they may include the following compounds.

Lauryl alcohol ethylene oxide addition ether:
Ethylene oxide 5-mol addition product, HLB value: 10.8
Ethylene oxide 10-mol addition product, HLB value: 14.1
Ethylene oxide 23-mol addition product, HLB value: 16.9
Oleyl alcohol ethylene oxide addition ether:
Ethylene oxide 10-mol addition product, HLB value: 12.4
Ethylene oxide 20-mol addition product, HLB value: 15.3
Nonyl phenyl alcohol ethylene oxide addition ether:
Ethylene oxide 4-mol addition product, HLB value: 8.9
Ethylene oxide 6-mol addition product, HLB value: 10.9
Ethylene oxide 7-mol addition product, HLB value: 11.7
Ethylene oxide 10-mol addition product, HLB value: 13.3
Ethylene oxide 12-mol addition product, HLB value: 14.1
Ethylene oxide 14-mol addition product, HLB value: 14.8

As an expression for calculating the HLB value of the surface-active agent component used in the present invention, the Griffin's HLB value-number method may be used which is as shown below.

(1) In the case of polyhydric alcohol fatty esters: HLB value=20 (1−S/A);

S: ester saponification value; and

A: neutralization value of fatty acid.

(2) In the cases of tall oil, rosin, beeswax and lauric polyhydric alcohol derivatives:

$$\text{HLB value}=(E+P)/5;$$

E: ethylene oxide content (% by mass) in constituent molecule; and

P: polyhydric alcohol content (% by mass) in constituent molecule.

(3) Where the hydrophilic group is ethylene oxide:

$$\text{HLB value}=E/5;$$

E: ethylene oxide content (% by mass) in constituent molecule.

As a production system, a continuous reaction system shown in FIG. 1 may preferable be used.

In FIG. 1, reference numerals 001 and 002 denote tanks which hold therein aqueous solutions, one of which is a tank holding therein (a) an aqueous fatty acid salt solution containing a surface-active agent [component (a)] and the other of which is a tank holding therein (b) an aqueous inorganic metal salt solution or dispersion containing a surface-active agent [component (b)]. Reference numeral 003 denotes a reactor; reference numeral 007, a disintegrator; and reference numeral 008, a fatty acid metal salt composition slurry tank. Reference numerals 004's each denote a constant-rate pump.

As the reactor 003, a reactor is preferable into a mixer of which the component (a) and component (b) can separately be fed to mix them. It is particularly preferable that the component (a) and component (b) can separately be fed into and mixed in the mixer at a rate and speed as high as possible. For example, a reactor is preferable into a mixing tank of which the respective raw-material solutions (or dispersions) can be introduced from respectively different directions to mix the solutions (or dispersions) together and at the same time the resultant mixture can be discharged from the mixing tank to the outside of the system. In particular, a reactor is preferable in which the component (a) and component (b) can be mixed in a good efficiency. It is also preferable that the component (a) and component (b) are reacted with each other in the state they are temperature-controlled at 70° C. to 90° C.

As an apparatus for these, it is preferable to use a line mill such as a flow jet mixer, a line homogenizer or a sand mill.

Where any unreacted fatty acid alkali metal salt or ammonium salt remains in the reaction product after the reaction of the component (a) with the component (b), the reaction may be carried out in the following way. After the reaction product of the component (a) with the component (b) has been discharged out of the mixing tank, an aqueous solution or dispersion containing an inorganic metal salt in an amount of from 0.001 to 15.0% by mass may be mixed with the reaction product, thus the unreacted fatty acid alkali metal salt or ammonium salt can be reacted with the fatty acid metal salt composition.

A slurry containing the fatty acid metal salt composition for which the reaction has been completed goes through the disintegrator 007, then it is held as a reaction slurry in the slurry tank 008, and then sent to the next step (here, it may go through a classification step). A circulation system may also be set up in which the reaction slurry is first returned to the disintegrator 007 and then again subjected to disintegration.

There are no particular limitations on an apparatus usable here as the disintegrator. Usable are, e.g., Milder L-Series (manufactured by Pacific Machinery & Engineering Co., Ltd.) and Proshear Mixer (manufactured by Pacific Machinery & Engineering Co., Ltd.). What may preferably be used is Milder L-Series the generator of which has been converted to have the shape of teeth.

The reaction slurry thus obtained is separated into a fatty acid metal salt composition cake and a filtrate by means of a filter used commonly in the art. This fatty acid metal salt composition cake is sufficiently washed with hot water or the like in order to lower its impurity level. As washing water used here, ion exchanged water may preferably be used which has been adjusted to 50 microsiemens/m or less.

The fatty acid metal salt composition cake having been washed is subjected to drying in the next step, thus the fatty acid metal salt composition is obtained. As the drying, the fatty acid metal salt composition cake, if it is in a small quantity, may be so spread as to be in thin layers in a tray-shaped container, which may then be dried in a drying oven set to a stated temperature. When it is in a large quantity, a fluidized bed dryer (manufactured by Y.K. Ohkawara Seisakusho) or the like may preferably be used which carries out drying in air streams. Specific drying temperature may differ depending on the type of the fatty acid metal salt composition to be obtained, and may be, in the case of zinc stearate for example, from 40° C. or more to 90° C. or less. Drying at a temperature higher than 90° C. may cause mutual agglomeration of fine particles to bring about a possibility of making the particles have a large average particle diameter. On the other hand, drying at a temperature of lower than 40° C. is undesirable because it takes a time to remove water content in the fatty acid metal salt composition by drying. The drying of the fatty acid metal salt composition cake may be carried out at normal pressure, but, in some cases, in order to carry out the drying efficiently, may be effected by reduced-pressure drying or vacuum drying. Besides, the fatty acid metal salt composition cake may be subjected to washing with a low-boiling solvent or the like and thereafter the resultant fatty acid metal salt composition cake may be dried. As the low-boiling solvent used in such a case, a solvent capable of removing the water from the fatty acid metal salt composition cake in a good efficiency is preferred, which may include, e.g., methanol, ethanol, acetone and methylene chloride.

Raw materials used when the fatty acid metal salt composition is produced are described next.

As raw-material components, (a) the aqueous fatty acid salt solution containing a surface-active agent [component (a)] and (b) the aqueous inorganic metal salt solution or dispersion containing a surface-active agent [component (b)] are used.

As the fatty acid salt used in preparing the component-(a) aqueous fatty acid salt solution, any of salts (e.g., alkali metal salts and ammonium salts) of the preferable fatty acids described previously and the other fatty acids may be used. From the viewpoint of manufacture, it is preferable to use a salt of a fatty acid having 4 to 30 carbon atoms. The fatty acid having carbon atoms within such a range has an appropriate solubility in water and can achieve a high production efficiency.

In the component-(a) aqueous fatty acid salt solution, the fatty acid salt may be in a content ranging from 0.001% by mass to 20% by mass. As long as it is in a content within this range, the production efficiency and the controlling of particle size of the fatty acid metal salt composition to be obtained can well be balanced. Taking account of the quantity of the fatty acid metal salt composition to be obtained and the particle size thereof, the alkali metal salt or ammonium salt of the fatty acid in the aqueous solution may more preferably be in a content ranging from 0.5% by mass to 15% by mass.

The nonionic surface-active agent is also added to the aqueous system of the component (a). As the surface-active agent used here, one kind or some kinds selected from the nonionic surface-active agents exemplified previously may be used.

The nonionic surface-active agent may be used in an amount of from 0.1% by mass to 10.0% by mass based on the aqueous system of the component (a). If the nonionic surface-active agent is added in an amount of less than 0.1% by mass, it is difficult to lower the center particle size of the fatty acid metal salt composition. If on the other hand it is in an amount of more than 10.0% by mass, the fatty acid metal salt composition to be obtained may have poor charge characteristics and, in addition thereto, the disposal of waste water may require a large load, uneconomically.

The inorganic metal salt used in the component-(b) aqueous inorganic metal salt solution or dispersion may include as examples thereof chlorides, sulfates, carbonates, nitrates or phosphates of alkaline earth metals such as calcium, barium and magnesium, and chlorides, sulfates, carbonates, nitrates or phosphates of metals such as titanium, zinc, copper, manganese, cadmium, mercury, zirconium, lead, iron, aluminum, cobalt, nickel and silver. Any of these materials may be used alone or may be used in combination of two or more types.

In the component-(b) aqueous inorganic metal salt solution or dispersion, the inorganic metal salt may preferably be in a content ranging from 0.001% by mass to 20% by mass. As long as it is in a content within this range, the production efficiency and the controlling of particle size of the fatty acid metal salt composition to be obtained can well be balanced. Taking account of the quantity of the fatty acid metal salt composition to be obtained and the particle size thereof, the inorganic metal salt in the aqueous solution or dispersion may more preferably be in a content ranging from 0.01% by mass to 10% by mass.

In respect to the component (b) as well, it is good to use a surface-active agent like the component (a). The type and amount of the surface-active agent may be the same type and same content to water as in the component (a), but the type may be changed to use a plurality of surface-active agents. It is also preferable to control its content in respect to the component (b), using the same surface-active agent as that in the component (a).

As the water used in preparing the component (a) and component (b), any water used commonly may be used. What is preferable is water having impurities such as metal ions in a small level, such as ion-exchanged water, purified water or distilled water.

The reaction ratio of the component (a) to the component (b) in producing the fatty acid metal salt composition may arbitrarily be changed. In particular, the (b) component may be so set as to be theoretically necessary mole equivalent weight or more as cation atoms in that component, with respect to the molar weight of carboxylic acid contained in the fatty acid salt of the component (a). This is preferable in order to stabilize the charge characteristics of the fatty acid metal salt composition and remedy the melt adhesion of toner to the toner carrying member. It is more preferable that the component (b) is so set as to be 1.1 times or more the mole equivalent weight with respect to the component (a).

Thus, the fatty acid metal salt composition containing the surface-active agent is obtained by mixing the two components to allow them to react with other.

The fatty acid metal salt composition may preferably be in a content of from 0.02 part by mass to 1.00 part by mass, and more preferably from 0.05 part by mass to 0.50 part by mass, based on 100 parts by mass of the toner base particles.

As long as the fatty acid metal salt composition is in the content within the above range, the effect of preventing toner filming to toner transport members can well be obtained, and also toner leak in drops can well be kept from occurring.

The fatty acid metal salt composition is used as an external additive, which may preferably be used in combination with the other external additive(s) described later.

As treating methods for its external addition to the toner base particles, known methods are available. For example, Henschel mixer (manufactured by Mitsui Miike Engineering Corporation) and Hybridizer (manufactured by Nara Machinery Co., Ltd.) may be used as apparatus therefor.

Preferred embodiments of the toner base particles are described next.

There are no particular limitations on how to produce the toner base particles as long as the desired properties can be achieved. More specifically, usable are a melt-kneading pulverization process, a suspension polymerization process, an emulsion polymerization process, a suspension granulation process and the like.

Of these, systems of suspension polymerization process, emulsion polymerization process and suspension granulation process are preferred, which have the step of producing toner base particles in an aqueous medium, and suspension polymerization or suspension granulation carried out in an aqueous medium is particularly preferred. What is further preferred is to use a production process which enables formation of toner base particles having as composition of toner base particles such a core-shell structure that brings out stress resistance.

A process for producing the toner base particles by polymerization may include a direct polymerization process, a suspension polymerization process, an emulsion polymerization process and a seed polymerization process. Of these, in view of readiness to balance particle diameter and particle shape, it is particularly preferable to produce the toner base particles by the suspension polymerization process. In this suspension polymerization process, in a polymerizable monomer, a colorant and further optionally a polymerization initiator, a cross-linking agent, a charge control agent and other additives are uniformly dissolved or dispersed to make up a monomer composition. Thereafter, this monomer composition is dispersed in a continuous phase (e.g., an aqueous phase) containing a dispersion stabilizer, by means of a suitable stirrer, and then polymerization reaction is carried out to obtain toner base particles having the desired particle diameters.

In the case when the toner is produced by this suspension polymerization process, the individual toner particles stand uniform in a substantially spherical shape, and hence a toner having a high circularity can be obtained with ease. Moreover, such a toner can also have a relatively uniform charge quantity distribution, and hence can have a high transfer performance.

Further, the toner base particles having a core-shell structure may optionally be designed in which surface layers are provided by again adding a polymerizable monomer and a polymerization initiator to fine particles obtained by suspension polymerization.

The toner contains a colorant such as a pigment or dye as an essential component so as to be provided with coloring power. An organic pigment or dye used preferably in the present invention may include the following.

Organic pigments or organic dyes usable as cyan colorants may include copper phthalocyanine compounds and derivatives thereof, anthraquinone compounds, basic dye lake compounds and so forth. Stated specifically, they may include C.I. Pigment Blue 1, C.I. Pigment Blue 7, C.I. Pigment Blue 15, C.I. Pigment Blue 15:1, C.I. Pigment Blue 15:2, C.I. Pigment Blue 15:3, C.I. Pigment Blue 15:4, C.I. Pigment Blue 60, C.I. Pigment Blue 62 and C.I. Pigment Blue 66.

As organic pigments or organic dyes usable as magenta colorants, condensation azo compounds, diketopyrrolopyrrole compounds, anthraquinone compounds, quinacridone compounds, basic-dye lake compounds, naphthol compounds, benzimidazolone compounds, thioindigo compounds and perylene compounds are used. Stated specifically, they may include C.I. Pigment Red 2, C.I. Pigment Red 3, C.I. Pigment Red 5, C.I. Pigment Red 6, C.I. Pigment Red 7, C.I. Pigment Red 19, C.I. Pigment Red 23, C.I. Pigment Red 48:2, C.I. Pigment Red 48:3, C.I. Pigment Red 48:4, C.I. Pigment Red 57:1, C.I. Pigment Red 81:1, C.I. Pigment Red 122, C.I. Pigment Red 144, C.I. Pigment Red 146, C.I. Pigment Red 150, C.I. Pigment Red 166, C.I. Pigment Red 169, C.I. Pigment Red 177, C.I. Pigment Red 184, C.I. Pigment Red 185, C.I. Pigment Red 202, C.I. Pigment Red 206, C.I. Pigment Red 220, C.I. Pigment Red 221 and C.I. Pigment Red 254.

Organic pigments or organic dyes usable as yellow colorants may include condensation azo compounds, isoindolinone compounds, anthraquinone compounds, azo metal complexes, methine compounds and allylamide compounds. Stated specifically, they may include C.I. Pigment Yellow 12, C.I. Pigment Yellow 13, C.I. Pigment Yellow 14, C.I. Pigment Yellow 15, C.I. Pigment Yellow 17, C.I. Pigment Yellow 62, C.I. Pigment Yellow 74, C.I. Pigment Yellow 83, C.I. Pigment Yellow 93, C.I. Pigment Yellow 94, C.I. Pigment Yellow 95, C.I. Pigment Yellow 97, C.I. Pigment Yellow 109, C.I. Pigment Yellow 110, C.I. Pigment Yellow 111, C.I. Pigment Yellow 120, C.I. Pigment Yellow 127, C.I. Pigment Yellow 128, C.I. Pigment Yellow 129, C.I. Pigment Yellow 147, C.I. Pigment Yellow 151, C.I. Pigment Yellow 154, C.I. Pigment Yellow 168, C.I. Pigment Yellow 174, C.I. Pigment Yellow 175, C.I. Pigment Yellow 176, C.I. Pigment Yellow 180, C.I. Pigment Yellow 181, C.I. Pigment Yellow 191 and C.I. Pigment Yellow 194.

Any of these colorants may be used alone, in the form of a mixture, or further in the state of a solid solution. The colorants used in the toner may be selected taking account of hue angle, chroma, brightness, light-fastness, transparency on OHP films and dispersibility in toner base particles.

The colorant may be used in its addition in an amount of from 1 part by mass to 20 parts by mass based on 100 parts by mass of the binder resin.

As black colorants, carbon black and colorants toned in black by the use of yellow, magenta and cyan colorants shown above may be used.

In order to obtain good fixed images, the toner of the present invention may preferably have a release agent in an amount of from 0.5 part by mass to 50 parts by mass based on 100 parts by mass of the binder resin. As the release agent, various types of waxes may be exemplified.

The release agent usable in the toner of the present invention may include petroleum waxes and derivatives thereof such as paraffin wax, microcrystalline wax and petrolatum; montan wax and derivatives thereof; hydrocarbon waxes obtained by Fischer-Tropsch synthesis, and derivatives thereof; polyolefin waxes typified by polyethylene wax, and derivatives thereof; and naturally occurring waxes such as carnauba wax and candelilla wax, and derivatives thereof.

Such derivatives include oxides, block copolymers with vinyl monomers, and graft modified products. Also usable are higher aliphatic alcohols, fatty acids such as stearic acid and palmitic acid, or compounds thereof, acid amide waxes, ester waxes, ketones, hardened caster oil and derivatives thereof, vegetable waxes, and animal waxes.

Of these waxes, those having a maximum endothermic peak temperature of from 40° C. to 110° C. in differential scanning calorimetry (DSC) are preferred, and those having that of from 45° C. to 90° C. are more preferred. Still more preferred are paraffin wax and Fischer-Tropsch wax, which have a maximum endothermic peak temperature of from 70° C. to 85° C. as measured by DSC.

The maximum endothermic peak temperature of the release agent component is measured according to ASTM D3418-82. For the measurement, for example, DSC-7 is used, which is manufactured by Perkin-Elmer Corporation. The temperature at the detecting portion of the instrument is corrected on the basis of melting points of indium and zinc, and the amount of heat is corrected on the basis of heat of fusion of indium. A pan made of aluminum is used for a sample for measurement, and an empty pan is set as a control to make measurement at a heating rate of 10° C./min.

When the release agent is used, it may preferable in a content ranging from 0.5 part by mass to 50 parts by mass based on 100 parts by mass of the binder resin. If it is in a content of less than 0.5 part by mass, the toner may low effectively be kept from low-temperature offset. If it is in a content of more than 50 parts by mass, the toner may have a poor long-term storage stability and besides other toner materials may come poorly dispersible, resulting in a lowering of fluidity of the toner and a lowering of image characteristics.

Further, in the toner of the present invention, it is preferable to use a charge control agent.

As the charge control agent, e.g., organic metal compounds and chelate compounds are effective, including monoazo metal compounds, acetylacetone metal compounds, aromatic hydroxycarboxylic acids, and aromatic dicarboxylic acid metal compounds. Besides, it may include aromatic mono- or polycarboxylic acids, and metal salts of these, anhydrides of these, esters of these, and phenol derivatives of these such as bisphenol derivatives. It may also include a styrene-acrylic acid copolymer, a styrene-methacrylic acid copolymer, a styrene-acrylic-sulfonic acid copolymer, and non-metal carboxylic acid compounds.

Of these, monoazo metal complexes, aromatic hydroxycarboxylic acid metal complexes, aromatic dicarboxylic acid metal complexes and metal salts of these are further preferred. Still further preferred are monoazo metal complexes the central metal atom of which is Fe, Al, Cr or Ni, aromatic hydroxycarboxylic acid metal complexes the central metal atom of which is Fe or Al, and metal salts of these, as well as copolymers of monomers containing a styrene-acrylate-sulfonic acid group.

In particular, where the toner base particles are produced by carrying out polymerization in an aqueous medium, preferred from the viewpoint that their layer structure can be controlled during polymerization reaction are aromatic hydroxycarboxylic acid metal complexes the central metal atom of which is Fe or Al and copolymers of monomers containing a styrene-acrylate-sulfonic acid group.

The toner of the present invention may preferably have, in view of durability (running performance), a weight average particle diameter (D4) of from 3.0 μm to 15.0 μm, and more preferably from 5.0 μm to 10.0 μm. A toner of less than 3.0 μm in D4 tends to adhere to a surface layer of the toner carrying member at the time of development to tend to inhibit its chargeability. Especially where halftone images are reproduced immediately after patterns with different image print percentages have been reproduced, the use of a toner containing toner particles of less than 3.0 μm in D4 in a large quantity tends to cause developing ghost. The toner having such a small particle diameter also tends to melt-adhere to the toner carrying member surface, and hence it shows a tendency of causing contamination of the toner carrying member during running.

The toner of the present invention may also preferably have, in its particle size distribution, a ratio of D4/D1 found by dividing weight average particle diameter (D4) by number average particle diameter (D1), of from 1.05 or more to less than 1.90, more preferably from 1.05 or more to less than 1.50, and still more preferably from 1.10 or more to less than 1.30. Where the toner satisfies it within this range, the quality of halftone images can well be maintained throughout running.

In the toner of the present invention, its particle shapes may preferably be controlled for the purpose of improving charging stability, developing performance, transfer performance and fluidity.

As a preferable range for such particle shape control in the toner of the present invention, the toner may preferably have, in a number-based circle-equivalent diameter—circularity scattergram of the toner as measured with a flow-type particle image analyzer, an average circularity of from 0.920 to 0.995 and a circularity standard deviation of 0.040 or less, and more preferably an average circularity of from 0.950 to 0.990 and a circularity standard deviation of 0.035 or less.

As long as the toner of the present invention has average circularity and circularity standard deviation within the above ranges, it can well achieve both chargeability and cleaning performance, and also can be kept from coming to melt-adhere to the toner carrying member surface.

The toner of the present invention is required to contain the fatty acid metal salt composition as an external additive. In addition thereto, an external additive(s) other than the fatty acid metal salt composition may preferably externally be add to the toner base particles for the purpose of improving charging stability, developing performance, fluidity and running performance.

Such an external additive may include as specific examples thereof fine silica powder, hydrophobic-treated fine silica powder, titanium oxide, surface hydrophobic-treated titanium oxide, and various resin particles. Any of these may preferably be used alone or in combination of two or more types.

Of these, hydrophobic-treated fine silica powder and titanium oxide are more preferred. Two or more kinds of other external additives may further be used in combination.

As the hydrophobic-treated fine silica powder used preferably in the present invention, any known fine silica powder may be used. What may preferably be uses is one having a specific surface area of 20 $m^2/g$ or more, and more preferably within the range of from 40 to 400 $m^2/g$, as measured by the BET method, utilizing nitrogen gas absorption.

A hydrophobic-treating agent in the hydrophobic-treated fine silica powder may include as specific examples thereof a silicone varnish, a modified silicone varnish of various types, a silicone oil, a modified silicone oil of various types, a silane coupling agent, a silane coupling agent having a functional group, and other organosilicon compounds. Any of these treating agents may be used alone or in the form of a mixture.

The hydrophobic-treated fine silica powder may be used in an amount of, but not particularly specified to, from 0.2 part by mass to 5.0 parts by mass, and preferably from 0.7 part by mass to 3.0 parts by mass, based on 100 parts by mass of the toner base particles.

Image formation making use of the toner of the present invention is described next.

As an image forming method to which the toner of the present invention is applicable, the toner may be used without limitation to any of a two-component developing method and a one-component developing method. It is also not limited to any grouping into magnetic and non-magnetic for toners, and is usable in either toner of the both.

As a condition for the step of development in the image forming method, the toner carrying member and the photosensitive member that is the electrostatic latent image bearing member may be in contact or in non-contact. Here, a case in which they are in contact is described with reference to FIG. 2.

A developing assembly 104 holds a toner 108 therein, and has a toner carrying member 105 which is rotated in the direction of an arrow in contact with an electrostatic latent image bearing member (photosensitive member) 101. It further has a developer blade 117 for controlling the toner level and charging the toner triboelectrically, and a coating roller 116 which is rotated in the direction of an arrow in order to make the toner 108 adhere to the toner carrying member 105 and also charge the toner by its friction with the toner carrying member 105. To the toner carrying member 105, a development bias power source is connected. A bias power source (not shown) is also connected to the coating roller 116, where a voltage is set on the negative side with respect to the development bias when a negatively chargeable toner is used and on the positive side with respect to the development bias when a positively chargeable toner is used.

Here, the length of rotational direction, what is called development nip width, at the contact zone between the photosensitive member 101 and the toner carrying member 105 may preferably be from 0.2 mm to 8.0 mm. If it is less than 0.2 mm, the amount of development may be too short to attain a satisfactory image density with ease and also the transfer residual toner tends to be insufficiently collected. If it is more than 8.0 mm, the toner may be fed in excess to tend to cause fog and also tend to cause the photosensitive member to wear seriously.

The toner coat level is controlled by the developer blade 117. This developer blade 117 is kept in contact with the toner carrying member 105 through the toner layer. Here, its contact pressure may be from 4.9 to 49 N/m (5 to 50 gf/cm) as a preferable range. If the contact pressure is lower than 4.9 N/m, it may be difficult not only to control the toner coat level but also to effect uniform triboelectric charging, causing fog to occur. On the other hand, if the contact pressure is higher than 49 N/m, the toner particles may undergo an excess load to tend to cause deformation of particles or the melt-adhesion of toner to the developing blade or toner carrying member, undesirably.

The free edge of the toner coat level control member may have any shape as long as it affords a preferable NE length (the length extending from the zone where the developer blade comes in contact with the toner carrying member to the free edge). Its sectional shape may be in variety in its use, and may be linear. Besides the linear shape, it may be in L-shape, bent in the vicinity of the edge, or may be in a shape made spherical in the vicinity of the edge, any of which may preferably be used.

As the toner coat level control member, a metallic blade or the like may also be used besides the elastic blade for coating the toner in pressure contact.

As the elastic control member, it is preferable to select a material of triboelectric series suited for charging the toner triboelectrically to the desired polarity, including, e.g., rubber elastic materials such as silicone rubber, urethane rubber and NBR; synthetic resin elastic materials such as polyethylene terephthalate; and metallic elastic materials such as stainless steel, steel and phosphor bronze, as well as composite materials thereof, any of which may be used.

Where the elastic control member and the toner carrying member are required to have a durability, resin or rubber may preferably be stuck to, or coated on, the metal elastic material so as to touch the part coming into contact with the sleeve.

Further, an organic or inorganic material may be added to, may be melt-mixed in, or may be dispersed in, the elastic control member. For example, any of metal oxides, metal powders, ceramics, carbon allotropes, whiskers, inorganic fibers, dyes, pigments and surface-active agents may be added so that the chargeability of the toner can be controlled. Especially when the elastic member is formed of a molded product of rubber or resin, it is also preferable to incorporate therein a fine metal oxide powder of silica, alumina, titania, tin oxide, zirconium oxide or zinc oxide, carbon black, or a charge control agent commonly used in toners.

A DC electric field and/or an AC electric field may also be applied to the control member, whereby the uniform thin-layer coating performance and uniform charging performance can be more improved because of the loosening action acting on the toner, so that a sufficient image density can be achieved and images with a good quality can be formed.

As a charging member, it includes a non-contact-type corona charging assembly and a contact-type charging member making use of a roller or the like, either of which may be used. The contact charging type may preferably be used in order to enable efficient and uniform charging, simplify the system and make ozone less occur.

Figure 2:
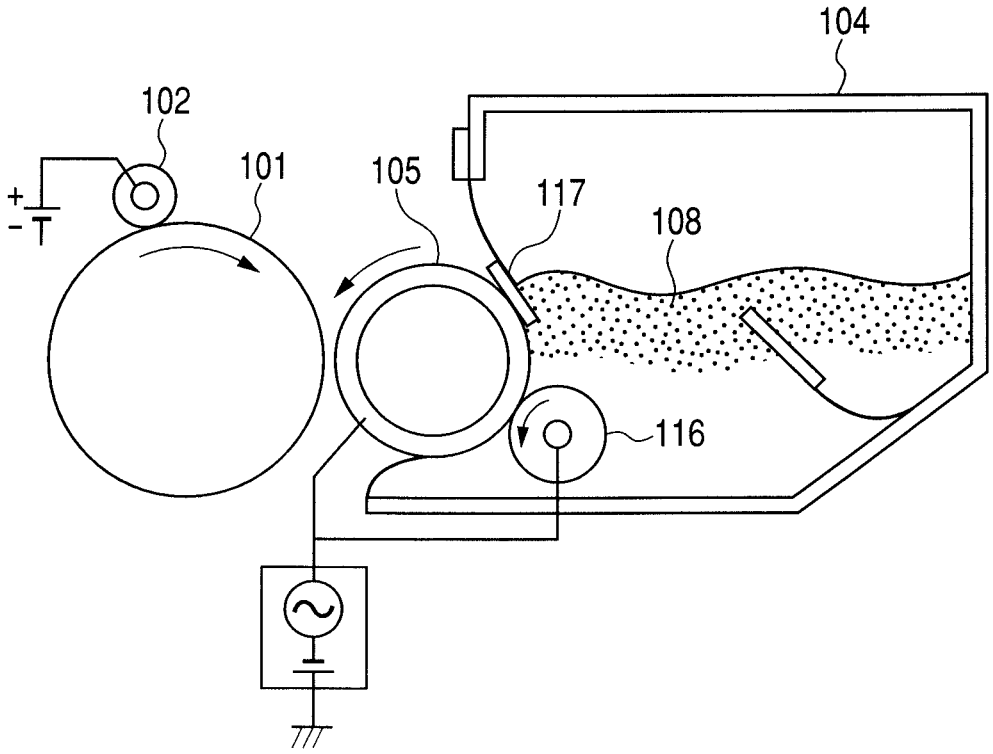
FIG. 2 is a schematic view of a non-magnetic one-component developing assembly.

In what is shown in FIG. 2, a contact-type charging member is used.

A primary charging member 102 used in what is shown in FIG. 2 is a charging roller constituted basically of a mandrel at the center and a conductive elastic layer that forms the periphery of the former. The charging roller is brought into contact with the surface of the electrostatic latent image bearing member 101 under a pressing force and is follow-up rotated as the electrostatic latent image bearing member 101 is rotated.

When the charging roller is used, the charging process may preferably be performed under conditions of a roller contact pressure of 4.9 to 490 N/m (5 to 500 gf/cm), and an AC voltage of 0.5 to 5 kVpp, an AC frequency of 50 Hz to 5 kHz and a DC voltage of plus-minus 0.2 to plus-minus 1.5 kV when a voltage formed by superimposing an AC voltage on a DC voltage is used as applied voltage, and a DC voltage of from plus-minus 0.2 to plus-minus 5 kV when a DC voltage is applied. In order to enable control of the depth of wear of the drum (photosensitive member), the case in which only the DC voltage is used as applied voltage is more preferred. As a contact charging means other than this, there are available a method making use of a charging blade and a method making use of a conductive brush. These contact charging means are advantageous in that they make high voltage unnecessary and make ozone less occur, compared with non-contact corona charging.

The charging roller and charging blade as contact charging means may preferably be made of a conductive rubber, and a release coat may be provided on its surface. The release coat may be formed of a nylon resin, PVDF (polyvinylidene fluoride) or PVDC (polyvinylidene chloride), any of which may be used.

As description of the image forming apparatus shown in FIG. 2, it has been described on the contact charging means. The same apparatus and conditions may also be used in image forming apparatus constructed differently, as long as the contact charging means is used.

As the toner carrying member, an elastic roller may be used and a method may be used in which the toner is coated on the elastic roller surface and the coated toner is brought into contact with the photosensitive member surface. As the elastic roller, a roller may preferably be used whose elastic layer has an ASKER-C hardness of from 30 to 60 degrees. Where the development is performed in the state the toner carrying member and the photosensitive member surface are brought into contact with each other, the development is performed by the aid of an electric field acting between the photosensitive member and the elastic roller facing the photosensitive member surface through the toner. Hence, it is necessary for the elastic roller surface or the vicinity of the surface to have a potential so that an electric field can be formed at a narrow gap between the photosensitive member surface and the toner carrying member surface. Accordingly, a method may also be used in which an elastic rubber of the elastic roller is controlled to have a resistance in the medium-resistance region, and keeps the electric field while preventing its conduction to the photosensitive member surface, or a thin-layer insulating layer is provided on the surface layer of a conductive layer.

The toner may preferably be coated on the toner carrying member in a level of from 0.1 mg/cm$^2$ to 1.5 mg/cm$^2$. If coated in a level of less than 0.1 mg/cm$^2$, it is difficult to attain a sufficient image density, and, in a level of more than 1.5 mg/cm$^2$, it is difficult to uniformly triboelectrically charge all the individual toner particles, providing a factor of causing fog. It may more preferably be coated in a level of from 0.2 mg/cm$^2$ to 0.9 mg/cm$^2$.

In the image-forming method of the present invention, the toner carrying member may be rotated in the same direction as, or the reverse direction to, the photosensitive member at the former's zone facing the latter. In the case when the both are rotated in the same direction, the peripheral speed of the toner carrying member may preferably be set 1.05 to 2.0 times the peripheral speed of the photosensitive member.

As the photosensitive member, preferably used is a photosensitive drum or photosensitive belt having a photoconductive insulating material layer formed of a-Se, CdS, $ZnO_2$, OPC (organic photoconductor), a-Si or the like.

A photosensitive layer in such an OPC photosensitive member may be of a single-layer type in which the photosensitive layer contains a charge generating material and a charge transporting material in the same layer, or may be a function-separated photosensitive layer composed of a charge transport layer and a charge generation layer. A multilayer-type photosensitive layer which is so structured that the charge generation layer and then the charge transport layer are superposed in this order on a conductive substrate is one of preferred examples. As binder resins for the organic photosensitive layer, there are no particular limitations thereon. Polycarbonate resins, polyester resins or acrylic resins are particularly preferable because they provide a good transfer performance, and can not easily cause melt-adhesion of toner to the photosensitive member and filming of external additives.

Image formation making use of the toner of the present invention is described below with reference to FIG. 3.

Figure 3:
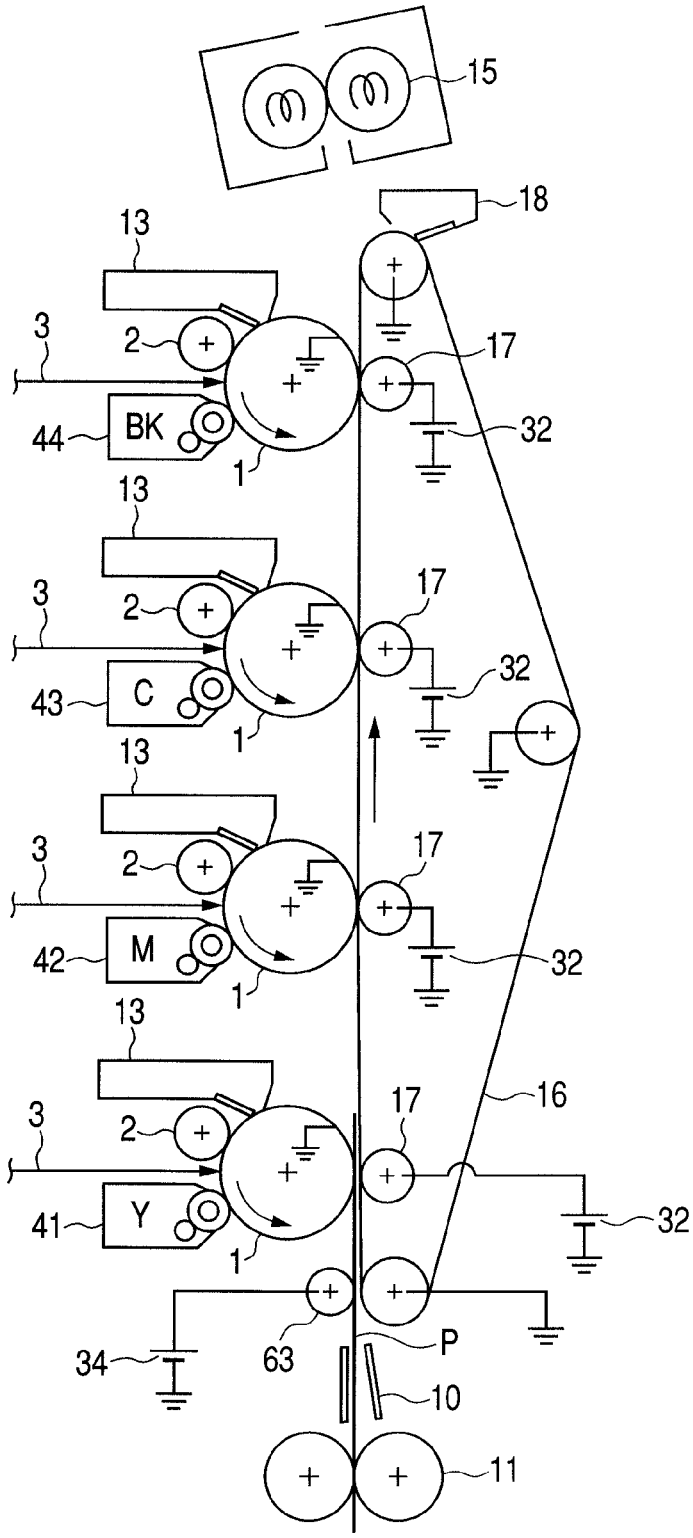
FIG. 3 is a schematic view of a full-color image forming apparatus.

In FIG. 3, each reference numeral 1 denotes a photosensitive member; letter symbol P, a transfer material such as paper; reference numeral 16, an electrostatic transport belt which transports the transfer material; each reference numeral 17, a transfer member; reference numeral 15, a fixing assembly; and each reference numeral 2, a primary charging member which directly electrostatically charges the photosensitive member 1 in contact with it.

To each primary charging member 2, a bias power source (not shown) is connected so that the surface of each photosensitive member 1 can uniformly electrostatically be charged.

A power source 32 for transfer bias with a polarity reverse to that of the photosensitive member 1 is connected to each transfer member (transfer roller) 17.

Electrostatic latent images are formed on each electrostatic latent image bearing member (photosensitive member) 1 upon exposure to light 3, and then developed sequentially by means of Y (yellow), M (magenta), C (cyan) and Bk (black) developing assemblies 41, 42, 43 and 44, respectively, to form first- to fourth-color toner images, and these toner images formed and held on the respective photosensitive members 1 are sequentially transferred to the transfer material P transported through paper feed means 11, 10 and 63.

Transfer bias for sequential superimposing transfer of the first- to fourth-color toner images from the respective photosensitive members 1 to the transfer material P being transported on the electrostatic transport belt 16 has a polarity reverse to that of the toner and is applied from a bias power source (not shown).

Thereafter, unfixed multi-color toner images transferred onto the transfer material P enter the fixing assembly 15, and are fixed onto the transfer medium P by the action of heat and pressure, thus fixed multi-color images are obtained.

After the transfer of toner images to the transfer material P is completed, a cleaning member 18 is brought into contact with the electrostatic transport belt 16 to collect the toner (transfer residual toner) remaining on the electrostatic transport belt 16 without being transferred to the transfer material P. The surface of each photosensitive member 1 is cleaned with each cleaning member 13.

The electrostatic transport belt 16 comprises a beltlike base layer and a surfacing layer provided on the base layer. The surfacing layer may be constituted of a plurality of layers. In the base layer and the surfacing layer, rubber, elastomer or resin may be used.

For example, the rubber or elastomer may include natural rubber, isoprene rubber, styrene-butadiene rubber, butadiene rubber, butyl rubber, ethylene-propylene rubber, ethylene-propylene terpolymer, chloroprene rubber, chlorosulfonated polyethylene, and chlorinated polyethylene. Also usable are acrylonitrile butadiene rubber, urethane rubber, syndiotactic 1,2-polybutadiene, epichlorohydrin rubber, acrylic rubber, silicone rubber, fluororubber, polysulfide rubber, polynorbornene rubber, and hydrogenated nitrile rubbers. Further usable is/are one or more materials selected from the group consisting of thermoplastic elastomers as exemplified by polystyrene type, polyolefin type, polyvinyl chloride type, polyurethane type, polyamide type, polyester type and fluorine resin type elastomers. However, examples are by no means limited to these materials.

As the resin, resins such as polyolefin resins, silicone resins, fluorine resins and polycarbonate resins may be used. Copolymers or mixtures of any of these resins may also be used.

As the base layer, a core material layer may be used which has the form of woven fabric, nonwoven fabric, yarn or film on one side or both sides of which any of the above rubbers, elastomers and resins is coated, soaked or sprayed.

As materials constituting the core material layer, usable are, but not particularly limited to, e.g., natural fibers such as cotton, silk and linen; synthetic fibers such as polyester fiber, nylon fiber, acrylic fiber, polyolefin fiber, polyvinyl chloride fiber, polyvinylidene chloride fiber, polyurethane fiber, and polyalkylparaoxybenzoate fiber. Further usable is/are one or more materials selected from the group consisting of synthetic fibers such as polyacetal fiber, aramid fiber, polyfluoroethylene fiber and phenol fiber; inorganic fibers such as carbon fiber and glass fiber; and metal fibers such as iron fiber and copper fiber.

A conducting agent may further be added to the base layer and surfacing layer in order to control the resistivity of the electrostatic transport belt. There are no particular limitations on the conducting agent. For example, usable are one or more agents selected from the group consisting of carbon powder, metal powders such as aluminum or nickel powder, metal oxides such as titanium oxide, and conductive polymeric compounds such as quaternary ammonium salt-containing polymethyl methacrylate, polydiacetylene and polyethyleneimine.

The toner of the present invention may be used in an image forming apparatus in which an intermediate transfer belt is used to one-time transfer multiple toner images to the recording medium. An example of how the image forming apparatus having such an intermediate transfer belt is set up is described with reference to FIG. 4. Constituent members or means corresponding to those in FIG. 3 are shown by like reference numerals.

In the course the toner images formed and held on each electrostatic latent image bearing member (photosensitive member) 1 pass a nip between the photosensitive member 1 and an intermediate transfer belt 5, they are primarily transferred sequentially to the peripheral surface of the intermediate transfer belt 5 by the aid of an electric field formed by a primary transfer bias applied to the intermediate transfer belt 5 through each primary transfer roller 6 from each bias power source 30.

The primary transfer bias for the sequential superimposing transfer of the first- to fourth-color toner images from the respective photosensitive members to the intermediate transfer belt 5 has a polarity reverse to that of the toner and is applied from a bias power source (not shown).

In the step of the primary transfer of the first- to third-color toner images from the photosensitive drums 1 to the intermediate transfer belt 5, a secondary transfer roller 7 and a cleaning charging member 18 may stand apart from the intermediate transfer belt 5.

Reference numeral 7 denotes the secondary transfer roller, which is axially supported in parallel to a secondary transfer opposing roller 8 and is so provided as to be separable from the bottom part of the intermediate transfer belt 5.

To transfer to a transfer material P multi-color toner images transferred onto the intermediate transfer belt 5, the secondary transfer roller 7 is brought into contact with the intermediate transfer belt 5 and also the transfer material P is fed to the contact nip between the intermediate transfer belt 5 and the secondary transfer roller 7 at a given timing, where a secondary transfer bias is applied from a bias power source 31 to the secondary transfer roller 7. By the aid of this secondary transfer bias, the multi-color toner images are secondarily transferred from the intermediate transfer belt 5 to the transfer material P.

Thereafter, unfixed multi-color toner images transferred onto the transfer material P enter a fixing assembly 15, and are fixed onto the transfer medium P by the action of heat and pressure, thus fixed multi-color images are obtained.

After the transfer of toner images to the transfer material P is completed, a cleaning member 18 is brought into contact with the intermediate transfer belt 5 to collect the toner (transfer residual toner) remaining on the intermediate transfer belt 5 without being transferred to the transfer material P.

The intermediate transfer belt 5 comprises a beltlike base layer and a surfacing layer provided on the base layer. The surfacing layer may be constituted of a plurality of layers. In the base layer and the surfacing layer, rubber, elastomer or resin may be used.

For example, as the rubber and the elastomer, usable are one or more materials selected from the group consisting of natural rubber, isoprene rubber, styrene-butadiene rubber, butadiene rubber, butyl rubber, ethylene-propylene rubber, ethylene-propylene terpolymer, chloroprene rubber, chlorosulfonated polyethylene, chlorinated polyethylene, acrylonitrile butadiene rubber, urethane rubber, syndiotactic 1,2-polybutadiene, epichlorohydrin rubber, acrylic rubber, silicone rubber, fluororubber, polysulfide rubber, polynorbornene rubber, hydrogenated nitrile rubber, and thermoplastic elastomers (e.g., polystyrene type, polyolefin type, polyvinyl chloride type, polyurethane type, polyamide type, polyester type and fluorine resin type elastomers). However, examples are by no means limited to these materials.

As the resin, resins such as polyolefin resins, silicone resins, fluorine resins and polycarbonate resins may be used. Copolymers or mixtures of any of these resins may also be used.

As the base layer, a core material layer having the form of woven fabric, nonwoven fabric, yarn or film on one side or both sides of which any of the above rubbers, elastomers and resins is coated, soaked or sprayed may be used.

As materials constituting the core material layer, usable are, but not particularly limited to, one or more materials selected from the group consisting of, e.g., natural fibers such as cotton, silk and linen; regenerated fibers such as chitin fiber, alginic acid fiber and regenerated cellulose fiber; semi-synthetic fibers such as acetate fiber; synthetic fibers such as polyester fiber, nylon fiber, acrylic fiber, polyolefin fiber, polyvinyl alcohol fiber, polyvinyl chloride fiber, polyvinylidene chloride fiber, polyurethane fiber, polyalkylparaoxybenzoate fiber, polyacetal fiber, aramid fiber, polyfluoroethylene fiber and phenol fiber; inorganic fibers such as carbon fiber, glass fiber and boron fiber; and metal fibers such as iron fiber and copper fiber.

A conducting agent may further be added to the base layer and surfacing layer in order to control the resistivity of the intermediate transfer belt. There are no particular limitations on the conducting agent. For example, usable are one or more agents selected from the group consisting of carbon powder, metal powders such as aluminum or nickel powder, metal oxides such as titanium oxide, and conductive polymeric compounds such as quaternary ammonium salt-containing polymethyl methacrylate, polyvinyl aniline, polyvinyl pyrrole, polydiacetylene, polyethyleneimine, boron-containing polymeric compounds, and polypyrrole.

How to measure various physical properties according to the present invention is described below together.

Quantitative Determination of Nonionic Surface-Active Agent:

The content of the nonionic surface-active agent in the fatty acid metal salt composition may quantitatively be determined in the following way.

Stated specifically, it may be determined by analyzing, with use of a gas chromatograph having a mass analyzer, a heat-desorptive organic volatile matter obtained by heating the fatty acid metal salt composition. As a preferable measuring instrument, an instrument may be used which is set up in combination of TRACE 2000GC (manufactured by ThermoQuest Corporation) and a head space sampler.

Measured under conditions of:

Extraction conditions: 120.0° C.;

Sample quantity: 1.0 g; and

Column: 0.32 mm Capillary column.

How to specify unknown substances from a chart may be practiced by library detection from a mass spectrum chart, in respect of substances whose peaks stand in sight. After the substances have been specified, a peak due to the nonionic surface-active agent among the respective substances is set as the surface-active agent peak. Here, to make quantitative determination, calibration curves are prepared using standard reagents of the surface-active agent used at the time of synthesis and substances determined from the mass spectrum chart, and the substances analyzed were quantitatively determined on the basis of the calibration curves. As to peaks not completely identifiable, they are regarded as unknown peaks and are removed from determination operation.

Since the analysis is made by the above method, only volatilizable components participate in the measurement. Hence, it is not the case that all nonionic surface-active agents in the fatty acid metal salt composition are determined. However, in the present invention, this method is employed for the analysis because the results of measurement and the performance are in correspondence to each other.

Measurement of Particle Diameter and Particle Size Distribution of Fatty Acid Metal Salt Composition:

The particle diameter and particle size distribution of the fatty acid metal salt composition are measured with a laser diffraction/scattering particle size distribution measuring instrument LA-920 (manufactured by Horiba Ltd.). Measuring conditions are set and measured data are analyzed both using a software attached to LA-920 for its exclusive use.

As a specific way of measurement, first, a batch-type cell holding therein an electrolyte solution as a measuring medium (a medium prepared by dissolving guaranteed sodium chloride in ion-exchanged water in a concentration of about 1% by mass, e.g., "ISOTON II", available from Beckman Coulter, Inc.) is set in the laser diffraction/scattering particle size distribution measuring instrument LA-920 (manufactured by Horiba Ltd.), where its optical axis is adjusted and the background is adjusted.

Next, about 1 mg of the fatty acid metal salt composition, about 0.2 ml of a dilute solution prepared by diluting "CONTAMINON N" as a dispersant with ion-exchanged water to about 3-fold by mass and 20 ml of an aqueous electrolytic solution are added to a 30 cc sample bottle made of glass. What is obtained by putting this sample bottle to ultrasonic dispersion for 60 seconds by means of an ultrasonic dispersion machine is used as a fluid dispersion for measurement. The above "CONTAMINON N" is an aqueous 10% by mass solution of a pH 7 neutral detergent for washing precision measuring instruments which is composed of a nonionic surface-active agent, an anionic surface-active agent and an organic builder and is available from Wako Pure Chemical Industries, Ltd. Any substitute therefor may be used as long as the like effect is obtainable. For the purpose of keeping the resultant fluid dispersion from again agglomerating thereafter, the measurement is made within 1 minute after the ultrasonic irradiation.

As the ultrasonic dispersion machine, UH-50 Model (manufactured by SMT Co., Ltd.) is used, which is fitted with a titanium alloy tip of 5 mm in diameter as a vibrator. The ultrasonic dispersion is carried out while the fluid dispersion is cooled in a water bath so that the temperature of the fluid dispersion may not come to 40° C. or more during the dispersion.

The fatty acid metal salt composition fluid dispersion obtained is added to the batch-type cell until it come to 95% to 90% in transmittance of light of a tungsten lamp, and its particle size distribution is measured.

Measurement of Melting Point:

The melting point is measured with a differential scanning calorimeter DSC-7 (manufactured by Perkin-Elmer Corporation.) and according to ASTM D3418-82. Measured under conditions of a heating rate of 1.0° C./min (without modulation), raising temperature from room temperature up to 150.0° C.

As to the melting point of the fatty acid metal salt composition, the maximum endothermic peak temperature in the measurement results obtained is termed as the melting point.

Measurement of Particle Size Distribution of Toner:

The weight average particle diameter (D4) and number average particle diameter (D1) of the toner are measured with a precision particle size distribution measuring instrument "Coulter Counter Multisizer 3" (registered trade mark; manufactured by Beckman Coulter, Inc.), having an aperture tube of 100 μm in size and employing the aperture impedance method.

A software "Coulter Counter Multisizer 3 Version 3.51" (produced by Beckman Coulter, Inc.) attached to Multisizer 3 for its exclusive use is also used, which is to set the conditions for measurement and analyze the data of measurement. To analyze the data of measurement, the data are analyzed on the basis of data obtained by measurement through 25,000 channels as effective measuring channels in number, to calculate the weight average particle diameter (D4) and number average particle diameter (D1) of the toner.

As an aqueous electrolytic solution used for the measurement, a solution may be used which is prepared by dissolving guaranteed sodium chloride in ion-exchanged water in a concentration of about 1% by mass, e.g., "ISOTON II" (available from Beckman Coulter, Inc.).

Here, before the measurement and analysis are made, the software for exclusive use is set in the following way.

On a "Change of Standard Measuring Method (SOM)" screen of the software for exclusive use, the total number of counts of a control mode is set to 50,000 particles. The number of time of measurement is set to one time and, as Kd value, the value is set which has been obtained using "Standard Particles, 10.0 μm" (available from Beckman Coulter, Inc.). Threshold value and noise level are automatically set by pressing "Threshold Value/Noise Level Measuring Button". Then, current is set to 1,600 μA, gain to 2, and electrolytic solution to ISOTON II, where "Flash for Aperture Tube after Measurement" is checked.

On a "Setting of Conversion from Pulse to Particle Diameter" screen of the software for exclusive use, the bin distance is set to logarithmic particle diameter, the particle diameter bin to 256 particle diameter bins, and the particle diameter range to from 2 μm to 60 μm.

A specific way of measurement is as follows:

(1) About 200 ml of the aqueous electrolytic solution is put into a 250 ml round-bottomed beaker made of glass for exclusive use in Multisizer 3 and this is set on a sample stand, where stirring with a stirrer rod is carried out at 24 revolutions/second in the anticlockwise direction. Then, "Flash of Aperture" function of the analysis software is operated to beforehand remove any dirt and air bubbles in the aperture tube.

(2) About 30 ml of the aqueous electrolytic solution is put into a 100 ml flat-bottomed beaker made of glass, and about 0.3 ml of a dilute solution prepared by diluting "CONTAMINON N" as a dispersant with ion-exchanged water to about 3-fold by mass is added thereto. This "CONTAMINON N" is an aqueous 10% by mass solution of a pH 7 neutral detergent for washing precision measuring instruments which is composed of a nonionic surface-active agent, an anionic surface-active agent and an organic builder and is available from Wako Pure Chemical Industries, Ltd.

(3) An ultrasonic dispersion machine of 120 W in electric output "Ultrasonic Dispersion system TETORAL 50" (manufactured by Nikkaki Bios Co.) is readied, having two oscillators of 50 kHz in oscillation frequency which are built therein in the state their phases are shifted by 180 degrees. Into its water tank, a stated amount of ion-exchanged water is put, and about 2 ml of the above CONTAMINON N is added to this water tank.

(4) The beaker of the above (2) is set to a beaker fixing hole of the ultrasonic dispersion machine, and the ultrasonic dispersion machine is set working. Then, the height position of the beaker is so adjusted that the state of resonance of the aqueous electrolytic solution surface in the beaker may become highest.

(5) In the state the aqueous electrolytic solution in the beaker of the above (4) is irradiated with ultrasonic waves, about 10 mg of the toner is little by little added to the aqueous electrolytic solution and is dispersed therein. Then, such ultrasonic dispersion treatment is further continued for 60 seconds. In carrying out the ultrasonic dispersion treatment, the water temperature of the water tank is appropriately so controlled as to be 10° C. or more to 40° C. or less.

(6) To the round-bottomed beaker of the above (1), placed inside the sample stand, the aqueous electrolytic solution in which the toner has been dispersed in the above (5) is dropwise added by using a pipette, and the measuring concentration is so adjusted as to be about 5%. Then the measurement is made until the measuring particles come to 50,000 particles in number.

(7) The data of measurement are analyzed by using the above software attached to the measuring instrument for its exclusive use, to calculate the weight average particle diameter (D4) and number average particle diameter (D1). Here, "Average Diameter" on an "Analysis/Volume Statistic Value (Arithmetic Mean)" screen when set to graph/% by volume in the software for exclusive use is the weight average particle diameter (D4), and "Average Diameter" on an "Analysis/Number Statistic Value (Arithmetic Mean)" screen when set to graph/% by number in the software for exclusive use is the number average particle diameter (D1).

Measurement of Particle Shape of Toner:

Circle-equivalent diameter and circularity of the toner and their frequency distribution are used as simple ways for expressing the shape of toner particles quantitatively. Here, the circle-equivalent diameter and circularity of the toner and their frequency distribution are measured with a flow-type particle image analyzer "FPIA-3000 Model" (manufactured by Sysmex Corporation), and are calculated according to the following expressions.

$$\text{Circle-equivalent diameter} = (\text{particle projected area}/\pi)^{1/2} \times 2.$$

$$\text{Circularity} = (\text{circumferential length of a circle with the same area as particle projected area})/(\text{circumferential length of particle projected image}).$$

Herein, the "particle projected area" is defined as the area of a binary-coded toner particle image, and the "circumferential length of particle projected image" is defined as the length of a contour line formed by connecting edge points of the toner particle image.

The circularity is an index showing the degree of surface unevenness of toner particles. It is indicated as 1.00 when the toner particles are perfectly spherical. The more complicate the surface shape is, the smaller the value of circularity is.

Circle-equivalent number average diameter which means an average value of number-based particle diameter frequency distribution, and particle diameter standard deviation SDd, of the toner are calculated from the following expressions where the particle diameter at a partition point i of particle size distribution (a central value) is represented by di, and the frequency by m.

$$\text{Circle-equivalent number average diameter } \bar{d}_1 = \frac{\sum_{i=1}^{n}(fi \times di)}{\sum_{i=1}^{n}(fi)}$$

$$\text{Particle diameter standard deviation } SDd = \left\{\frac{\sum_{i=1}^{n}(\bar{d}_1 - di)^2}{\sum_{i=1}^{n-1}(fi)}\right\}^{1/2}$$

Average circularity which means an average value of circularity frequency distribution and circularity standard deviation SDc are calculated from the following expressions where the circularity at a partition point i of particle size distribution (a central value) is represented by ci, and the frequency by fci.

$$\text{Average circularity } \bar{c} = \frac{\sum_{i=1}^{m}(ci \times fci)}{\sum_{i=1}^{m}(fci)}$$

$$\text{Circularity standard deviation } SDc = \left\{\frac{\sum_{i=1}^{m}(\bar{c} - ci)^2}{\sum_{i=1}^{m-1}(ci)}\right\}^{1/2}$$

As a specific way of measurement, 10 ml of ion-exchanged water from which impurity solid matter and the like have beforehand been removed is readied in a container, and a surface active agent, preferably an alkylbenzenesulfonate, is added thereto as a dispersant. Thereafter, about 0.02 g of a sample for measurement is further added thereto, followed by uniform dispersion. As a means for dispersing it, an ultrasonic dispersion machine UH-50 Model (manufactured by SMT Co.) is used to which a 5 mm diameter titanium alloy tip is attached as a vibrator, and dispersion treatment is carried out for 5 minutes to prepare a fluid dispersion for measurement. Here, the fluid dispersion is appropriately cooled so that its temperature may not exceed 40° C.

The toner particle shape is measured using the above flow-type particle image analyzer. Concentration of the fluid dispersion is again so adjusted that the toner particles are in a concentration of 8,000 particles/μl at the time of measurement, and 1,000 or more toner particles are measured. After measurement, the data obtained are used to determine the average circularity and circularity standard deviation of the toner.

EXAMPLES

The present invention is described below in greater detail by giving Examples. The present invention is by no means limited by the Examples.

Fatty Acid Metal Salt Composition

Production Example 1

In this Production Example, the fatty acid metal salt composition was synthesized by the method in which a solution of an inorganic metal compound is dropwise added to a solution of an alkali metal salt of a fatty acid to carry out reaction in the presence of a nonionic surface-active agent (the double decomposition process).

A continuous reaction system having a wet-process classifier was used (see FIG. 1). Flow jet mixers in which the component (a) and component (b) can separately be fed and mixed by means of constant-rate pumps and a 10-liter receiving container with a stirrer having turbine blades of 6 cm in diameter were readied, and the turbine blades were rotated at 400 rpm. In this system, the component (a) and component (b) having previously been temperature-controlled at 80° C. were simultaneously introduced from different directions into the flow jet mixers while their flow rates were so controlled as to be 3.0 liter/minute each.

Mixture solutions discharged out of the flow jet mixers were introduced into the receiving container. The flow rates of the respective solutions were so controlled by constant-rate pumps 004 that the solutions were simultaneously finished being forwarded. After the solutions were completely introduced into it, they were ripened for 10 minutes while being kept at 80° C., where the reaction was completed.

A reaction slurry containing the fatty acid metal salt composition for which the reaction was completed was sent to the disintegrator 007 (Milder L the generator of which was converted to have the shape of teeth), through which coarse particles were removed. The reaction slurry containing the fatty acid metal salt composition for which the reaction was completed was held in the tank 008, and then sent to the next step.

As the above component (a) and component (b), the following were used.

As the component (a), containing Surfactant shown in Table 1 and raw material A shown in Table 2, the following materials were mixed, which were mixed until the powder in the liquid came dispersed uniformly by means of a stirrer having dispersing blades.

Fatty acid A-1: sodium stearate, first grade (available from Kishida Chemical Co., Ltd.): 2.0 parts by mass.

Nonionic surface-active agent, Surfactant (1): 0.010 part by mass.

Water: 100 parts by mass.

This component (a) was introduced into the tank 001 shown in FIG. 1 for holding the raw material A-containing component (a).

As the component (b), containing Surfactant shown in Table 1 and raw material B shown in Table 2, the following materials were mixed, which were mixed until the powder in the liquid came dispersed uniformly by means of a stirrer having dispersing blades.

Inorganic metal salt B-1: zinc sulfate, first grade (available from Kishida Chemical Co., Ltd.): 2.2 parts by mass.

Nonionic surface-active agent, Surfactant (1): 0.010 part by mass.

Water: 100 parts by mass.

This component (b) was introduced into the tank 002 shown in FIG. 1 for holding the raw material B-containing component (b).

The total mass of the component (a) was so controlled that the fatty acid metal salt composition was in an amount of 5 kg after drying. The quantities of the component (a) and component (b) introduced respectively into flow jet mixers were also so controlled by the constant-rate pumps 004 that the (a) and (b) component feed rates came equal to each other, to carry out the mixing and reaction.

Next, the fatty acid metal salt composition slurry thus obtained was filtered, and the resultant fatty acid metal salt composition cake was washed with water four times, using iron-exchanged water controlled to 20 μS/m or less. The fatty acid metal salt composition cake thus obtained as a result of washing was dried at 50° C. or less by means of a fluidized bed dryer (manufactured by Y.K. Ohkawara Seisakusho), into which dry nitrogen was introduced. The fatty acid metal salt composition thus obtained was sieved with a net of 35 μm in mesh opening in order to remove coarse particles contained therein, thus Fatty Acid Metal Salt Composition SA-1 was obtained.

In the foregoing, the reaction slurry was controlled to about 40° C., which was temperature suited for wet-process classification, by using a heat exchanger (not shown). In the wet-process classifier, the coarse-powder component was returned to the disintegrator 007 again via the heat exchanger, where it was again disintegrated together with the reaction slurry containing the fatty acid metal salt, and what was thus treated was circulated to the classification step.

Then, as described above, the fatty acid metal salt composition slurry thus obtained was filtered, and the resultant fatty acid metal salt composition cake was washed four times with water, using iron-exchanged water controlled to 20 μS/m or less. The fatty acid metal salt composition cake thus obtained as a result of washing was dried at 50° C. or less by means of the fluidized bed dryer (manufactured by Y.K. Ohkawara Seisakusho), into which dry nitrogen was introduced. The fatty acid metal salt composition thus obtained was sieved with a net of 35 μm in mesh opening in order to remove coarse particles contained therein, thus fatty acid metal salt composition (SA-1) was obtained. Physical properties of the fatty acid metal salt composition obtained are shown in Table 4.

Fatty Acid Metal Salt Compositions

Production Examples 2 to 18

Components (a) and components (b) were prepared using Surfactants shown in Table 1 and raw materials A and raw materials B, respectively, shown in Table 2 in combinations shown in Table 3.

Next, like Production Example 1, the quantities of each component (a) and each component (b) introduced respectively into flow jet mixers were so controlled by the constant-rate pumps 004 that the (a) and (b) component feed rates came equal to each other, to carry out the mixing and reaction to obtain fatty acid metal salt compositions (SA-2 to SA-18); provided that, in respect of Production Examples 4, 5 and 6, the fatty acid metal salt composition cakes in that step were each washed with water 10 times, and that, in respect of Production Examples 14 and 15, the fatty acid metal salt composition cakes in that step were each washed with water twice.

Physical properties of the fatty acid metal salt compositions obtained are shown in Table 4.

TABLE 1

| Surfactant | Type | | Trade name | Maker | HLB value |
|---|---|---|---|---|---|
| (1) | Nonionic | Polyoxyalkylene alkyl ether | NAROACTY N-70 | Sanyo Chem. Ind. | 11.7 |
| (2) | Nonionic | Polyoxyalkylene alkyl ether | EMULGEN LS106 | Kao Corporation | 12.5 |
| (3) | Nonionic | Polyoxyalkylene alkyl ether | EMULGEN MS110 | Kao Corporation | 12.7 |
| (4) | Nonionic | Polyoxyalkylene alkyl ether | EMULGEN LS114 | Kao Corporation | 14.0 |
| (5) | Nonionic | Polyoxyalkylene alkyl ether | NAROACTY N-160 | Sanyo Chem. Ind. | 15.2 |
| (6) | Nonionic | Polyoxyethylene alkyl ether | NAROACTY N-40 | Sanyo Chem. Ind. | 8.9 |
| (7) | Nonionic | Polyoxyethylene alkyl ether | SANNONIC SS-50 | Sanyo Chem. Ind. | 10.5 |
| (8) | Nonionic | Polyoxyethylene alkyl ether | EMULGEN 320P | Kao Corporation | 13.9 |
| (9) | Nonionic | Polyoxyethylene alkyl ether | EMULGEN 220 | Kao Corporation | 14.7 |
| (10) | Nonionic | Polyoxyethylene alkyl ether | NAROACTY N-200 | Sanyo Chem. Ind. | 16.0 |
| (11) | Nonionic | Polyoxyethylene alkyl ether | EMULMIN NL-110 | Kao Corporation | 14.4 |
| (12) | Nonionic | Polyoxyethylene alkyl phenyl ether | EMULGEN 909 | Kao Corporation | 12.4 |
| (13) | Nonionic | Polyoxyethylene alkyl phenyl ether | EMULGEN 911 | Kao Corporation | 13.7 |
| (14) | Nonionic | Polyoxyethylene fatty acid diester | IONET DL-200 | Sanyo Chem. Ind. | 6.6 |
| (15) | Nonionic | Polyoxyethylene fatty acid diester | IONET DL-400 | Sanyo Chem. Ind. | 8.4 |
| (16) | Ionic | Alkyl sulfuric ester | EMURL 2F Needle | Kao Corporation | — |
| (17) | Ionic | Polyoxyethylene alkyl ether sodium sulfate | SANDET ENM | Sanyo Chem. Ind. | — |

TABLE 2

| | | Type | Maker |
|---|---|---|---|
| Raw material A (fatty acid) | A-1 | Sodium stearate, first grade | Kishida Chemical Co., Ltd. |
| | A-2 | Sodium stearate | Kawamura Kasei Industry Co. |
| | A-3 | Ammonium stearate, first grade | Kishida Chemical Co., Ltd. |
| | A-4 | Sodium behenate (purity: 99%) | — |
| | A-5 | Potassium palmitate (purity: 98%) | — |
| | A-6 | Ammonium fatty beef tallow (purity: 98%) | — |
| Raw material B (inorganic salt) | B-1 | Zinc sulfate, first grade | Kishida Chemical Co., Ltd. |
| | B-2 | Zinc chloride | Kishida Chemical Co., Ltd. |
| | B-3 | Calcium chloride, first grade | Kishida Chemical Co., Ltd. |
| | B-4 | Magnesium sulfate | Kishida Chemical Co., Ltd. |

TABLE 3

| Fatty acid metal salt compo. | Component (a) Fatty acid component | | | Component (a) Surface-active agent | | Component (b) Inorganic metal salt | | | Component (b) Surface-active agent | |
|---|---|---|---|---|---|---|---|---|---|---|
| | | Type | Conc. (ms. %) | Type | Conc. (ms. %) | | Type | Conc. (ms. %) | Type | Conc. (ms. %) |
| SA-1 | A-1 | Sodium stearate | 2.0 | Surfactant (1) | 0.010 | B-1 | Zinc sulfate | 1.2 | Surfactant (1) | 0.010 |
| SA-2 | A-1 | Sodium stearate | 5.0 | Surfactant (2) | 0.020 | B-1 | Zinc sulfate | 2.8 | Surfactant (2) | 0.010 |
| SA-3 | A-2 | Sodium stearate | 2.0 | Surfactant (3) | 0.007 | B-2 | Zinc sulfate | 1.2 | Surfactant (3) | 0.005 |
| SA-4 | A-1 | Sodium stearate | 1.0 | Surfactant (4) | 0.005 | B-2 | Zinc sulfate | 1.5 | Surfactant (4) | 0.005 |
| SA-5 | A-1 | Sodium stearate | 9.8 | Surfactant (12) | 0.010 | B-2 | Zinc sulfate | 5.4 | Surfactant (12) | 0.010 |
| SA-6 | A-2 | Sodium stearate | 5.0 | Surfactant (13) | 0.010 | B-2 | Zinc sulfate | 3.1 | Surfactant (13) | 0.010 |
| SA-7 | A-2 | Sodium stearate | 5.0 | Surfactant (6) | 0.010 | B-3 | Calcium chloride | 2.8 | Surfactant (1) | 0.010 |
| SA-8 | A-4 | Sodium behenate | 5.0 | Surfactant (7) | 0.010 | B-3 | Calcium chloride | 2.8 | Surfactant (2) | 0.010 |
| SA-9 | A-5 | Potassium palmitate | 2.0 | Surfactant (8) | 0.010 | B-3 | Calcium chloride | 2.0 | Surfactant (3) | 0.010 |
| SA-10 | A-6 | Ammonium fatty beef tallow | 0.01 | Surfactant (9) | 0.005 | B-4 | Magnesium sulfate | 0.007 | Surfactant (4) | 0.005 |
| SA-11 | A-3 | Ammonium stearate | 10.2 | Surfactant (11) | 0.005 | B-4 | Magnesium sulfate | 5.0 | Surfactant (11) | 0.005 |
| SA-12 | A-2 | Sodium stearate | 4.0 | Surfactant (5) | 0.040 | B-4 | Magnesium sulfate | 2.4 | Surfactant (5) | 0.020 |
| SA-13 | A-6 | Ammonium fatty beef tallow | 2.2 | Surfactant (10) | 0.020 | B-2 | Zinc sulfate | 2.4 | Surfactant (10) | 0.030 |
| SA-14 | A-2 | Sodium stearate | 0.05 | Surfactant (14) | 0.010 | B-2 | Zinc sulfate | 1.0 | Surfactant (13) | 0.010 |
| SA-15 | A-2 | Sodium stearate | 10.4 | Surfactant (15) | 0.050 | B-2 | Zinc sulfate | 5.1 | Surfactant (15) | 0.020 |
| SA-16 | A-2 | Sodium stearate | 1.0 | Surfactant (16) | 0.010 | B-2 | Zinc sulfate | 1.0 | Surfactant (16) | 0.010 |
| SA-17 | A-2 | Sodium stearate | 1.0 | Surfactant (17) | 0.010 | B-2 | Zinc sulfate | 1.0 | Surfactant (17) | 0.010 |
| SA-18 | A-2 | Sodium stearate | 2.0 | — | — | B-3 | Calcium chloride | 2.1 | — | — |

Further, besides the above synthesized products, the following samples were also used from among commercially available fatty acid metal salts. All these do not contain any nonionic surface-active agent.

Fatty acid metal salt (SA-19):

Zinc stearate MZ-2, available from NOF Corporation.

Fatty acid metal salt (SA-20):

Zinc 12-hydroxystearate SZ-120HF, available from Sakai Chemical Industries Co., Ltd.

Fatty acid metal salt (SA-21):

Zinc stearyl phosphate LBT-1830F, available from Sakai Chemical Industries Co., Ltd.

TABLE 4

| Fatty acid metal salt composition | Amount of Surface-active agent (ppm) | Melting point (° C.) | Main peak particle diameter (μm) | Median diameter D50s (μm) | Span value |
|---|---|---|---|---|---|
| SA-1 | 200 | 124.7 | 0.51 | 0.47 | 0.92 |
| SA-2 | 170 | 124.6 | 0.47 | 0.42 | 0.81 |
| SA-3 | 210 | 123.5 | 0.51 | 0.47 | 0.95 |
| SA-4 | 20 | 124.9 | 0.19 | 0.28 | 1.31 |
| SA-5 | 11 | 124.8 | 0.70 | 0.78 | 1.55 |
| SA-6 | 22 | 123.4 | 0.51 | 0.58 | 1.62 |
| SA-7 | 200 | 124.5 | 0.42 | 0.48 | 0.97 |

TABLE 4-continued

| Fatty acid metal salt composition | Amount of Surface-active agent (ppm) | Melting point (° C.) | Main peak particle diameter (μm) | Median diameter D50s (μm) | Span value |
|---|---|---|---|---|---|
| SA-8 | 130 | 142.0 | 0.75 | 0.83 | 1.02 |
| SA-9 | 22 | 115.9 | 0.62 | 0.80 | 0.98 |
| SA-10 | 460 | 98.2 | 0.82 | 1.11 | 1.48 |
| SA-11 | 310 | 124.2 | 0.80 | 1.10 | 1.55 |
| SA-12 | 18 | 124.5 | 6.75 | 5.30 | 1.82 |
| SA-13 | 170 | 99.5 | 5.27 | 4.92 | 1.88 |
| SA-14 | 5 | 123.2 | 12.11 | 12.20 | 1.80 |
| SA-15 | 510 | 124.3 | 10.26 | 9.85 | 1.76 |
| SA-16 | 420 | 124.5 | 3.71 | 3.62 | 1.65 |
| SA-17 | 410 | 123.7 | 5.52 | 5.20 | 1.15 |
| SA-18 | Undetected | 123.9 | 4.20 | 3.31 | 1.95 |
| SA-19 | Undetected | 122.3 | 1.25 | 1.10 | 1.62 |
| SA-20 | Undetected | 148.2 | 0.81 | 0.79 | 1.15 |
| SA-21 | Undetected | 210.2 | 0.68 | 0.65 | 1.05 |

Production of Toner Base Particles

Toner Base Particles

Production Example 1

Into a 2-liter four-necked flask having a high-speed stirrer TK-homomixer, an aqueous sodium phosphate solution was introduced, and this was heated to 63° C., controlling the number of revolutions of the stirrer to 9,000 rpm. To the resultant mixture, an aqueous calcium chloride solution was slowly added to obtain an aqueous dispersion medium containing a fine sparingly water-soluble dispersant.

Styrene monomer: 80 parts by mass.

2-Ethylhexyl acrylate monomer: 20 parts by mass.

Divinyl benzene monomer: 0.1 part by mass.

Saturated polyester resin (terephthalic acid-propylene oxide modified bisphenol A; acid value: 15 mgKOH/g): 5 parts by mass.

Carbon black (average primary particle diameter: 40 nm): 8 parts by mass.

Release agent (behenyl behenate): 10 parts by mass.

Aluminum compound of benzilic acid: 2.0 parts by mass.

Meanwhile, the above materials were dispersed for 3 hours by means of a ball mill, and thereafter the contents were separated from the ball mill. The contents thus separated were heated to 65° C. Subsequently, 3 parts by mass of a polymerization initiator 2,2'-azobis(2,4-dimethylvaleronitrile) was added thereto to prepare a polymerizable monomer composition, which was then introduced into the above aqueous dispersion medium, followed by granulation while maintaining the number of revolutions of the stirrer at 9,000 rpm. Thereafter, the granulated product obtained was stirred with a paddle stirring blade, during which the reaction was carried out at 65° C. for 4 hours, and thereafter the polymerization reaction was carried out at 80° C. for 5 hours. Then, reduced-pressure distillation was carried out at 80° C. and at a pressure of 13.3 kPa (100 Torr) and residual monomers were removed, thus the polymerization reaction was completed.

After the reaction was completed, the resultant suspension was cooled, and hydrochloric acid was added thereto to dissolve the sparingly water-soluble dispersant, followed by filtration by means of a pressure filter, water washing with ion-exchanged water and then drying at a temperature of 45° C. or less, further followed by air classification to obtain toner base particles (1). The toner base particles thus obtained were analyzed to find that they contained 100 parts by mass of the binder resin.

Toner Base Particles

Production Example 2

Toner base particles (2) were obtained in the same way as in Toner Base Particles Production Example 1 except that, in Toner Base Particles Production Example 1, the concentration of the sparingly water-soluble dispersant was so controlled as to make the toner base particles have a weight average particle diameter of about 5 μm and that the temperature of the reduced-pressure distillation was changed to 90° C. and the degree of reduced pressure was adjusted.

Toner Base Particles

Production Example 3

Toner base particles (3) were obtained in the same way as in Toner Base Particles Production Example 1 except that, in Toner Base Particles Production Example 1, the concentration of the sparingly water-soluble dispersant was so controlled as to make the toner base particles have a weight average particle diameter of about 10 μm.

Toner Base Particles

Production Example 4

Toner base particles (4) were obtained in the same way as in Toner Base Particles Production Example 1 except that, in Toner Base Particles Production Example 1, the concentration of the sparingly water-soluble dispersant was so controlled as to make the toner base particles have a weight average particle diameter of about 11 μm.

Toner Base Particles

Production Example 5

Toner base particles (5) were obtained in the same way as in Toner Base Particles Production Example 1 except that, in Toner Base Particles Production Example 1, the concentration of the sparingly water-soluble dispersant was so controlled as to make the toner base particles have a weight average particle diameter of about 4.5 μm and that the temperature of the reduced-pressure distillation was changed to 90° C. and the degree of reduced pressure was adjusted.

Toner Base Particles

Production Example 6

Toner base particles (6) were obtained in the same way as in Toner Base Particles Production Example 1 except that, in Toner Base Particles Production Example 1, the concentration of the sparingly water-soluble dispersant was so controlled as to make the toner base particles have a weight average particle diameter of about 7.5 μm and that the temperature of the reduced-pressure distillation was changed to 90° C. and the degree of reduced pressure was adjusted.

Toner Base Particles

Production Example 7

Toner base particles (7) were obtained in the same way as in Toner Base Particles Production Example 1 except that, in Toner Base Particles Production Example 1, the carbon black was changed for C.I. Pigment Yellow 93, that the concentration of the sparingly water-soluble dispersant was so controlled as to make the toner base particles have a weight average particle diameter of about 7.5 μm and also that the temperature of the reduced-pressure distillation was changed to 90° C. and the degree of reduced pressure was adjusted.

Toner Base Particles

Production Example 8

Toner base particles (8) were obtained in the same way as in Toner Base Particles Production Example 1 except that, in Toner Base Particles Production Example 1, the carbon black was changed for C.I. Pigment Red 122, that the concentration of the sparingly water-soluble dispersant was so controlled as to make the toner base particles have a weight average particle diameter of about 7.5 μm and also that the temperature of the reduced-pressure distillation was changed to 90° C. and the degree of reduced pressure was adjusted.

Toner Base Particles

Production Example 9

Toner base particles (9) were obtained in the same way as in Toner Base Particles Production Example 1 except that, in Toner Base Particles Production Example 1, the carbon black was changed for C.I. Pigment Blue 15:3, that the concentration of the sparingly water-soluble dispersant was so controlled as to make the toner base particles have a weight average particle diameter of about 7.5 μm and also that the temperature of the reduced-pressure distillation was changed to 90° C. and the degree of reduced pressure was adjusted.

Toner Base Particles

Production Example 10

Styrene-n-butyl acrylate copolymer: 100 parts by mass.

Carbon black (average primary particle diameter: 40 nm): 6 parts by mass.

Aluminum compound of 3,5-diert-t-butylsalicylic acid: 4 parts by mass.

Ester wax: 2 parts by mass.

The above materials were thoroughly premixed by means of Henschel mixer. Next, the mixture obtained was melt-kneaded by means of a twin-screw extruder. The kneaded product obtained was cooled, and then the kneaded product cooled was crushed using a hammer mill to a size of about 1 to 2 mm. Then, the crushed product was finely pulverized by means of a fine grinding mill of an air jet system. The finely pulverized product was further so air-classified as to be about 6.5 μm in particle diameter to obtain toner base particles (10).

Toner Base Particles

Production Example 11

Toner base particles (11) were obtained in the same way as in Toner Base Particles Production Example 10 except that, in Toner Base Particles Production Example 10, the carbon black was changed for C.I. Pigment Yellow 74.

Toner Base Particles

Production Example 12

Toner base particles (12) were obtained in the same way as in Toner Base Particles Production Example 10 except that, in Toner Base Particles Production Example 10, the carbon black was changed for C.I. Pigment Red 84.

Toner Base Particles

Production Example 13

Toner base particles (13) were obtained in the same way as in Toner Base Particles Production Example 10 except that, in Toner Base Particles Production Example 10, the carbon black was changed for C.I. Pigment Blue 15:3.

Production of Toners

Toner Production Example 1

100 parts by mass of the toner base particles (1), 0.1 part by mass of the fatty acid metal salt composition (SA-1) and 1.5 parts by mass of hydrophobic fine silica powder (S-1) with a BET specific surface area of 200 $m^2/g$, having been treated with hexamethyldisilazane and dimethylsilicone oil were introduced into Henschel mixer (manufactured by Mitsui Mining Co. Ltd.). As the Henschel mixer, an inner volume 10 liter type was used, and treating conditions in the Henschel mixer were so set that a baffle plate was at 90 degrees with respect to the peripheral direction and the number of revolution was 3,000 rpm. Using this apparatus, the fatty acid metal salt composition (SA-1) and the other external additive component (S-1) were added to the toner base particles (1) at the same timing, and these were mixed for 10 minutes to obtain a toner (1).

Toner Production Examples 2 to 5

Toners (2) to (5) were obtained in the same way as in Toner Production Example 1 except that, based on 100 parts by mass of the toner base particles (1), the amounts of the fatty acid metal salt composition (SA-1) and the types and amounts of the hydrophobic fine silica powder were changed as shown in Table 5.

Toner Production Example 6

A toner (6) was obtained in the same way as in Toner Production Example 1 except that the fatty acid metal salt composition (SA-1) was used in combination with another fatty acid metal salt composition (SA-7), each in an amount of 0.05 part by mass based on 100 parts by mass of the toner base particles (1).

Toner Production Example 7

A toner (7) was obtained in the same way as in Toner Production Example 1 except that the fatty acid metal salt composition (SA-1) was changed for another fatty acid metal salt composition (SA-3).

Toner Production Example 8

A toner (8) was obtained in the same way as in Toner Production Example 1 except that the fatty acid metal salt composition (SA-1) was changed for another fatty acid metal salt composition (SA-4), the hydrophobic fine silica powder (S-1) was added in an amount changed to 1.4 part by mass and anatase-type titanium oxide (T-1) with a BET specific surface area of 25 $m^2/g$, having been treated with hexamethyldisilazane was further added in an amount of 0.3 part by mass. Here, the fatty acid metal salt composition, the hydrophobic fine silica powder and the titanium oxide were added to the toner base particles at the same timing.

Toner Production Examples 9 and 10

Toners (9) and (10) were obtained in the same way as in Toner Production Example 1 except that the fatty acid metal salt composition (SA-1) was changed for another fatty acid metal salt composition (SA-5) or fatty acid metal salt composition (SA-6) and the titanium oxide (T-1) was added in an amount of formulation as shown in Table 5. Here, the fatty acid metal salt composition, the hydrophobic fine silica powder and the titanium oxide were added to the toner base particles at the same timing.

Toner Production Examples 11 to 13

Toners (11) to (13) were obtained in the same way as in Toner Production Example 8 except that the toner base particles (2) and the fatty acid metal salt compositions (SA-7) to (SA-9) were used to prepare formulations shown in Table 5.

Toner Production Example 14

A toner (14) was obtained in the same way as in Toner Production Example 1 except that, based on 100 parts by mass of the toner base particles (3), 0.9 part by mass of the fatty acid metal salt composition (SA-10), 1.7 parts by mass of the hydrophobic fine silica powder (S-1) and 0.05 part by mass of hydrotalcite with a BET specific surface area of 8 $m^2/g$, having been treated with stearic acid, were added instead. Here, the fatty acid metal salt composition, the hydrophobic fine silica powder and the hydrotalcite were added to the toner base particles at the same timing.

Toner Production Examples 15 to 22

Toners (15) to (22) were obtained in the same way as in Toner Production Example 14 except that the materials were formulated as shown in Table 5.

Toner Production Examples 23 to 26

Toners (23) to (26) were obtained in the same way as in Toner Production Example 1 except that the toner base particles (6) to (9) and the fatty acid metal salt composition (SA-1) were used to prepare formulations shown in Table 5.

These toners are used in Examples given later, as a full-color toner set composed of a black toner, a yellow toner, a magenta toner and a cyan toner.

Toner Production Examples 27 to 30

Toners (27) to (30) were obtained in the same way as in Toner Production Example 1 except that the toner base particles (10) to (13) were used to prepare formulations shown in Table 5. These toners are used in Examples given later, as a full-color toner set composed of a black toner, a yellow toner, a magenta toner and a cyan toner.

Comparative Toner Production Examples 1 to 3

Comparative toners (1) to (3) were obtained in the same way as in Toner Production Example 1 except that the fatty acid metal salt composition (SA-1) was changed for the fatty acid metal salt compositions (SA-19) to (SA-21), respectively.

Comparative Toner Production Examples 4 to 7

Comparative toners (4) to (7) were obtained in the same way as in Toner Production Example 1 except that the toner base particles (10) to (13), respectively, and the fatty acid metal salt composition (SA-19) were used instead.

The formulation of external additives of the toners obtained and the physical properties of the toners are shown together in Table 5.

TABLE 5

| | | | External-additive formulation | | | | | | Toner physical properties | | | |
|---|---|---|---|---|---|---|---|---|---|---|---|---|
| | Toner base particles | | Fatty acid metal salt composition | | External additive 1 | | External additive 2 | | Weight average particle diameter | Particle size distribution | Average | Circularity standard |
| | No. | Color | Type | pbm | Type | pbm | Type | pbm | D4 (μm) | D4/D1 | circularity | deviation |
| Toner Production Example: | | | | | | | | | | | | |
| 1 | 1 | Bk | SA-1 | 0.1 | S-1 | 1.5 | — | — | 6.55 | 1.26 | 0.977 | 0.032 |
| 2 | 1 | Bk | SA-1 | 0.05 | S-1 | 1.5 | — | — | 6.54 | 1.25 | 0.976 | 0.032 |
| 3 | 1 | Bk | SA-2 | 0.4 | S-1 | 1.7 | — | — | 6.54 | 1.26 | 0.976 | 0.032 |
| 4 | 1 | Bk | SA-2 | 0.2 | S-2 | 1.5 | — | — | 6.55 | 1.26 | 0.977 | 0.032 |
| 5 | 1 | Bk | SA-2 | 0.06 | S-1 | 1.5 | — | — | 6.56 | 1.25 | 0.976 | 0.033 |
| 6 | 1 | Bk | SA-1<br>SA-7 | 0.05<br>0.05 | S-1 | 1.5 | — | — | 6.55 | 1.26 | 0.978 | 0.032 |
| 7 | 1 | Bk | SA-3 | 0.1 | S-1 | 1.5 | — | — | 6.54 | 1.26 | 0.978 | 0.032 |
| 8 | 1 | Bk | SA-4 | 0.1 | S-1 | 1.4 | T-1 | 0.3 | 6.55 | 1.26 | 0.977 | 0.031 |
| 9 | 1 | Bk | SA-5 | 0.2 | S-1 | 0.7 | T-1 | 0.8 | 6.56 | 1.27 | 0.977 | 0.031 |
| 10 | 1 | Bk | SA-6 | 0.1 | S-1 | 2.0 | T-1 | 0.3 | 6.55 | 1.26 | 0.978 | 0.032 |
| 11 | 2 | Bk | SA-7 | 0.2 | S-1 | 1.7 | T-1 | 0.2 | 5.20 | 1.31 | 0.966 | 0.029 |
| 12 | 2 | Bk | SA-8 | 0.1 | S-1 | 1.9 | T-2 | 0.05 | 5.19 | 1.31 | 0.965 | 0.028 |
| 13 | 2 | Bk | SA-9 | 0.1 | S-1 | 1.7 | T-2 | 0.1 | 5.19 | 1.32 | 0.966 | 0.029 |
| 14 | 3 | Bk | SA-10 | 0.9 | S-1 | 1.7 | T-3 | 0.05 | 9.80 | 1.14 | 0.975 | 0.034 |
| 15 | 3 | Bk | SA-11 | 0.1 | S-1 | 1.7 | T-3 | 0.3 | 9.79 | 1.14 | 0.976 | 0.033 |
| 16 | 3 | Bk | SA-12 | 0.1 | S-1 | 1.5 | T-2 | 0.1 | 9.79 | 1.13 | 0.975 | 0.034 |
| 17 | 4 | Bk | SA-13 | 0.42 | S-3 | 0.5 | T-1 | 1.5 | 11.20 | 1.33 | 0.977 | 0.033 |
| 18 | 4 | Bk | SA-14 | 0.55 | S-3 | 2.0 | T-2 | 0.2 | 11.19 | 1.31 | 0.975 | 0.030 |
| 19 | 4 | Bk | SA-15 | 0.01 | S-3 | 2.0 | T-3 | 0.5 | 11.19 | 1.33 | 0.977 | 0.033 |
| 20 | 5 | Bk | SA-16 | 0.2 | S-1 | 1.5 | — | — | 4.50 | 1.20 | 0.974 | 0.027 |
| 21 | 5 | Bk | SA-17 | 1.1 | S-1 | 1.5 | — | — | 4.49 | 1.19 | 0.975 | 0.028 |
| 22 | 5 | Bk | SA-18 | 0.97 | S-1 | 1.5 | — | — | 4.50 | 1.20 | 0.974 | 0.028 |
| 23 | 6 | Bk | SA-1 | 0.1 | S-1 | 1.5 | T-3 | 0.05 | 7.55 | 1.26 | 0.978 | 0.024 |
| 24 | 7 | Y | SA-1 | 0.1 | S-1 | 1.5 | T-3 | 0.05 | 7.48 | 1.26 | 0.978 | 0.026 |
| 25 | 8 | M | SA-1 | 0.2 | S-1 | 1.5 | — | — | 7.52 | 1.31 | 0.966 | 0.028 |
| 26 | 9 | C | SA-1 | 0.1 | S-1 | 1.5 | T-3 | 0.05 | 7.50 | 1.27 | 0.977 | 0.025 |
| 27 | 10 | Bk | SA-7 | 0.02 | S-1 | 1.5 | — | — | 6.60 | 1.32 | 0.960 | 0.042 |
| 28 | 11 | Y | SA-12 | 0.02 | S-1 | 1.5 | — | — | 6.40 | 1.31 | 0.962 | 0.041 |
| 29 | 12 | M | SA-7 | 0.02 | S-1 | 1.5 | — | — | 6.45 | 1.28 | 0.958 | 0.040 |
| 30 | 13 | C | SA-7 | 0.02 | S-1 | 1.5 | — | — | 6.62 | 1.30 | 0.959 | 0.040 |

TABLE 5-continued

| Comparative Toner Production Example: | | | | | | | | | | | | |
|---|---|---|---|---|---|---|---|---|---|---|---|---|
| 1 | 5 | Bk | SA-19 | 0.1 | S-1 | 1.5 | — | — | 4.50 | 1.19 | 0.974 | 0.027 |
| 2 | 5 | Bk | SA-20 | 0.1 | S-1 | 1.5 | — | — | 4.52 | 1.19 | 0.974 | 0.027 |
| 3 | 5 | Bk | SA-21 | 0.1 | S-1 | 1.5 | — | — | 4.52 | 1.19 | 0.974 | 0.027 |
| 4 | 10 | Bk | SA-19 | 0.1 | S-1 | 1.5 | — | — | 6.54 | 1.26 | 0.978 | 0.032 |
| 5 | 11 | Y | SA-19 | 0.1 | S-1 | 1.5 | — | — | 6.55 | 1.26 | 0.978 | 0.032 |
| 6 | 12 | M | SA-19 | 0.1 | S-1 | 1.5 | — | — | 5.20 | 1.31 | 0.966 | 0.029 |
| 7 | 13 | C | SA-19 | 0.1 | S-1 | 1.5 | — | — | 6.56 | 1.27 | 0.977 | 0.031 |

In Table 5, S-1 to S-3 and T-1 to T-3 stand for the following external additives.

S-1: Fine silica powder with a BET specific surface area of 200 $m^2/g$, having been hydrophobic-treated with hexamethyldisilazane and dimethylsiloxane.

S-2: Fine silica powder with a BET specific surface area of 300 $m^2/g$, having been hydrophobic-treated with dimethylsiloxane.

S-3: Fine silica powder with a BET specific surface area of 90 $m^2/g$, having been hydrophobic-treated with hexamethyldisilazane and dimethylsiloxane.

T-1: Anatase-type titanium oxide with a BET specific surface area of 25 $m^2/g$, having been hydrophobic-treated with hexamethyldisilazane.

T-2: Rutile-type titanium oxide with a BET specific surface area of 26 $m^2/g$, having been treated with hexamethyldisilazane.

T-3: Hydrotalcite having been treated with a higher fatty acid.

Example 1

An image forming apparatus used in this Examples is described below.

In this Example 1, the image forming apparatus as shown in FIG. 3 was used to make image evaluation.

FIG. 3 is a schematic view of a conversion machine of a color laser beam printer (LBP-5500, trade name; manufactured by CANON INC.), making use of an electrophotographic process of a non-magnetic one-component contact developing system. The transfer material P is, while a bias is applied through an attraction roller 63, attracted to and transported on the electrostatic transport belt 16. The respective-color toner images formed on the photosensitive members 41 to 44 are, while a bias with a polarity reverse to that of toners is applied through the transfer rollers 17, sequentially transferred to the transfer material P kept attracted onto the electrostatic transport belt 16, superimposed thereon and thereafter fixed by heating in the fixing assembly 15.

This evaluation machine is provided with four developing process cartridges respectively having cyan, yellow, magenta and black, four-color toners, and carries out an image forming process in which toner images formed by rendering electrostatic latent images visible by the use of these toners are sequentially transferred onto the transfer material and further the unfixed images on the transfer material are fixed.

The process cartridges are cartridges of the non-magnetic one-component contact developing system, in which developing rollers of the one-component developing assemblies as shown in FIG. 3 are brought into pressure contact with the electrostatic latent image bearing members (photosensitive members) to perform development, and the four process cartridges are disposed in an in-line form.

In this Example, an apparatus was used the conversion of which was made on the following items (a) to (f).

(a) The toner carrying members for the four colors all were so set as to be driven at a peripheral speed of 150% in the forward direction, with respect to the peripheral speed of the rotation of the photosensitive members.

(b) A blade (thickness: 0.4 mm) made of phosphor bronze was used for the toner coat layer control on each toner carrying member.

(c) The base layer side of each photosensitive member was grounded and the voltage to be applied across each toner carrying member and the photosensitive member at the time of development was fixed at a DC voltage of −330V.

(d) A DC voltage of 200 V was applied across each toner carrying member and the blade made of phosphor bronze, setting the blade side positive.

(e) The photosensitive members were each so adjusted to have a dark-area potential of −700 V and a light-area potential of −150 V.

(f) The transfer voltage applied in each station was set to a DC voltage of 1,770 V.

(g) The drive system was converted and the process speed was so controlled that images were reproduced at a speed of 30 sheets/minute in A4-lengthwise paper feed.

(h) The apparatus was driven in monochrome only (monochrome mode).

As Example 1, the above apparatus was used, and a cartridge developing assembly 44 was readied in which its developing assembly 104 having the structure shown in FIG. 2 was filled with the toner (1), a black (Bk) toner, obtained in Toner Production Example 1. The other developing assemblies 41, 42 and 43 were used as they were available as products. These were disposed in a line in the image forming apparatus as shown in FIG. 3.

Evaluation Conditions

The quantity of toner filled was 200 g. In a low-temperature and low-humidity environment (15° C./10% RH) or in a high-temperature and high-humidity environment (30° C./70% RH), images in horizontal lines which were so adjusted to be 1.0% in image print percentage were reproduced in an intermittent mode. As a manner for intermittent image reproduction, it was performed in such a way that three sheets of paper were fed, then a pause is taken for a time of 5 seconds and, from the state the process operation was completely stopped, sheets of paper were again fed. Images formed were evaluated at stages of the running initial stage (10 to 50 sheets), the running middle stage (10,000 sheets) and the running late stage (20,000 sheets) on the following items. The results of evaluation on these are shown in Tables 6 and 7.

Changes in Particle Size of Toner During Running:

At the running initial stage (50 sheets) and at the running middle stage (10,000 sheets), the toner in the developing assembly was collected in a small quantity from a toner supply opening, and its particle size was measured with Coulter Multisizer III, on the weight average particle diameter (D4), the proportion of volume-based 10.1 μm or larger particles and the proportion of number-based 3.17 μm or smaller particles. Using the results obtained, the "result on running middle-stage toner" was divided by the "result on running initial-stage toner" to calculate a proportion, and the value found was used as an index of the changes in particle size.

Toner Melt Adhesion:

At the respective running stages, the toner on the toner carrying member surface was removed by suction under reduced pressure, using a suction device having a narrowed tip. Next, a transparent pressure-sensitive tape (e.g., a transparent pressure-sensitive cellophane tape available from Nichiban Co., Ltd.) was put to the toner carrying member surface at its part from which the toner was removed, to collect any substance remaining on the toner carrying member surface. Then, this tape was stuck to a sheet of copying machine plain paper CLC Paper (basis weight: 80 g/m$^2$; available from CANON INC.). Further, a virgin tape of the same one as that used to collect the toner from the toner carrying member surface was stuck to the like paper as a background. Next, the density of toner at each of the taped areas was measured with a Macbeth densitometer (RD924, manufactured by Macbeth Co.), and the difference between them was calculated to make evaluation according to the following criteria.

A: The density is less than 0.050.

B: The density is 0.050 or more to less than 0.075.

C: The density is 0.075 or more to less than 0.125.

D: The density is 0.125 or more to less than 0.150.

E: The density is 0.150 or more.

Line Images:

Halftone images of 15% and 25% in print density were reproduced, and how any development lines on images (dark lines continuing on images) appeared was visually examined to make evaluation according to the following criteria.

A: Any line does not appear.

B: Lines little appear.

C: Few weak lines appear.

D: Many weak lines appear.

E: Conspicuous lines appear.

Halftone Image Quality:

Two-dots and three-space halftone images were reproduced at a resolution of 600 dpi, and halftone image quality (tone non-uniformity of development) was visually examined on the images obtained, to make evaluation according to the following criteria.

A: Any tone non-uniformity is not perceivable.

B: Tone non-uniformity is slightly seen, but is little disturbing.

C: Tone non-uniformity is somewhat seen.

D: Tone non-uniformity is perceivable.

E: Tone non-uniformity is very conspicuous.

Image Fog:

At the respective running stages, a chart having white background areas was reproduced on copying machine plain paper CLC Paper (basis weight: 80 g/m$^2$; available from CANON INC.). The whiteness at the white background areas of printed images and the whiteness of a virgin transfer sheet were measured with "REFLECTOMETER" (manufactured by Tokyo Denshoku Co., Ltd.), and fog density (reflection density) (%) was calculated from the difference between them to make evaluation according to the following criteria.

A: The reflection density is less than 0.3%.

B: The reflection density is 0.3% or more to less than 1.0%.

C: The reflection density is 1.0% or more to less than 2.0%.

D: The reflection density is 2.0% or more to less than 3.0%.

E: The reflection density is 3.0% or more.

Charge Contamination:

The state of contamination of the primary charging assembly and any influence on images which was caused by the contamination were visually examined to make evaluation according to the following criteria.

A: Contamination is little seen, and any image defects do not at all occur.

B: Contamination is somewhat seen, but do not affect images.

C: Contamination is seen, and is slightly seen to have affected images.

D: Contamination is seen, and is seen to have affected images.

E: Contamination is remarkably seen, and image defects occur which are due to faulty primary charging.

Examples 2 to 19

Images were formed in the same way as in Example 1 except that the toners 2 to 19 were used instead. Evaluation on the toners was made in the same way. The results of evaluation are shown in Tables 6 and 7.

Comparative Examples 1 to 3

Images were formed in the same way as in Example 1 except that the comparative toners (1) to (3) were used instead. Evaluation on the toners was made in the same way. The results of evaluation are shown in Tables 6 and 7.

TABLE 6

| | 15° C., 10% RH | | | | | | | | | | | |
|---|---|---|---|---|---|---|---|---|---|---|---|---|
| | Toner melt adhesion | | | Line images | | | Halftone images | | | Changes in particle size during running | | |
| | | | | | | | | | | | Proportion of: | |
| | 50 sheets | 10,000 sheets | 20,000 sheets | 50 sheets | 10,000 sheets | 20,000 sheets | 50 sheets | 10,000 sheets | 20,000 sheets | D4 proportion | 10.1 μm or more | 3.17 μm or less |
| Example: | | | | | | | | | | | | |
| 1 | A | A | A | A | A | A | A | A | A | 1.01 | 0.99 | 1.12 |
| 2 | A | A | B | A | A | A | A | A | A | 1.08 | 1.09 | 1.23 |
| 3 | A | A | A | A | A | A | A | A | A | 1.03 | 1.00 | 1.10 |
| 4 | A | A | A | A | A | A | A | A | A | 1.05 | 0.98 | 1.15 |

TABLE 6-continued

| | 15° C., 10% RH | | | | | | | | | | | |
|---|---|---|---|---|---|---|---|---|---|---|---|---|
| | Toner melt adhesion | | | Line images | | | Halftone images | | | Changes in particle size during running | | |
| | | | | | | | | | | | Proportion of: | |
| | 50 sheets | 10,000 sheets | 20,000 sheets | 50 sheets | 10,000 sheets | 20,000 sheets | 50 sheets | 10,000 sheets | 20,000 sheets | D4 proportion | 10.1 μm or more | 3.17 μm or less |
| 5 | A | A | B | A | A | A | A | A | A | 1.09 | 1.10 | 1.24 |
| 6 | A | A | A | A | A | A | A | A | A | 1.04 | 0.99 | 1.18 |
| 7 | A | A | A | A | A | A | A | A | A | 1.05 | 1.03 | 1.18 |
| 8 | A | A | A | A | A | A | B | B | A | 1.06 | 1.05 | 1.22 |
| 9 | A | A | A | A | A | A | B | B | A | 1.06 | 1.07 | 1.21 |
| 10 | A | A | A | A | A | A | B | A | A | 1.06 | 1.06 | 1.22 |
| 11 | A | A | B | A | A | B | A | B | B | 1.25 | 1.13 | 1.31 |
| 12 | A | A | B | A | A | B | A | B | B | 1.22 | 1.15 | 1.29 |
| 13 | A | A | B | A | A | B | B | B | B | 1.26 | 1.16 | 1.27 |
| 14 | A | B | B | A | A | B | B | B | B | 1.20 | 1.10 | 1.22 |
| 15 | A | B | B | A | B | B | B | B | B | 1.32 | 1.02 | 1.34 |
| 16 | A | B | C | A | A | B | B | A | A | 1.20 | 1.15 | 1.23 |
| 17 | A | C | C | A | A | B | A | B | B | 1.35 | 1.28 | 1.62 |
| 18 | A | B | B | A | A | B | A | B | C | 1.05 | 1.35 | 1.23 |
| 19 | A | C | C | A | B | C | B | B | B | 1.31 | 1.32 | 1.61 |
| Comparative Example: | | | | | | | | | | | | |
| 1 | A | C | E | A | A | B | C | C | E | 1.31 | 1.39 | 1.55 |
| 2 | A | C | E | A | C | E | B | C | E | 1.42 | 1.41 | 1.61 |
| 3 | A | D | E | A | D | E | C | B | C | 1.60 | 1.72 | 1.72 |

TABLE 7

| | 30° C.,70% RH | | | | | |
|---|---|---|---|---|---|---|
| | Image fog | | | Charge contamination | | |
| | 50 sheets | 10,000 sheets | 20,000 sheets | 50 sheets | 10,000 sheets | 20,000 sheets |
| Example: | | | | | | |
| 1 | A | A | A | A | A | A |
| 2 | A | A | A | A | A | A |
| 3 | A | A | A | A | A | A |
| 4 | A | A | A | A | A | A |
| 5 | A | A | A | A | A | A |
| 6 | A | A | A | A | A | A |
| 7 | A | A | A | A | A | A |
| 8 | A | A | B | A | A | A |
| 9 | A | A | B | A | A | A |
| 10 | A | B | B | A | A | A |
| 11 | A | B | B | A | A | A |
| 12 | A | B | B | A | A | A |
| 13 | A | B | B | A | A | A |
| 14 | A | A | B | A | B | B |
| 15 | A | B | C | A | C | C |
| 16 | B | C | C | B | B | C |
| 17 | C | B | D | A | B | C |
| 18 | A | B | C | A | B | C |
| 19 | A | B | C | A | B | B |
| Comparative Example: | | | | | | |
| 1 | B | C | OUT | C | E | OUT |
| 2 | B | C | OUT | C | E | OUT |
| 3 | C | D | OUT | C | E | OUT |

In Table 7, OUT indicates that the running test was stopped because of run-out of the toner.

It is seen from the above results that the use of the toner containing as an external additive the fatty acid metal salt composition which contains the nonionic surface-active agent and the fatty acid metal salt enables the toner to less change in particle size throughout running and to be improved in running stability. In addition, the fact that the toner may less change in particle size throughout running means that the toner has superior coat stability on the toner carrying member and superior developing performance on the toner carrying member, thus it is seen that the toner of the present invention is superior in these respects.

It is also seen that the toner containing as an external additive the fatty acid metal salt composition which contains the nonionic surface-active agent and the fatty acid metal salt has superior characteristics in respect of toner melt adhesion, line images and halftone image quality. This is presumed to be due to the fact that the toner can be kept from being charged in excess and can maintain appropriate charge characteristics even in an environment of low humidity, because of an effect brought by the nonionic surface-active agent contained in the fatty acid metal salt composition.

Example 23

Figure 4:
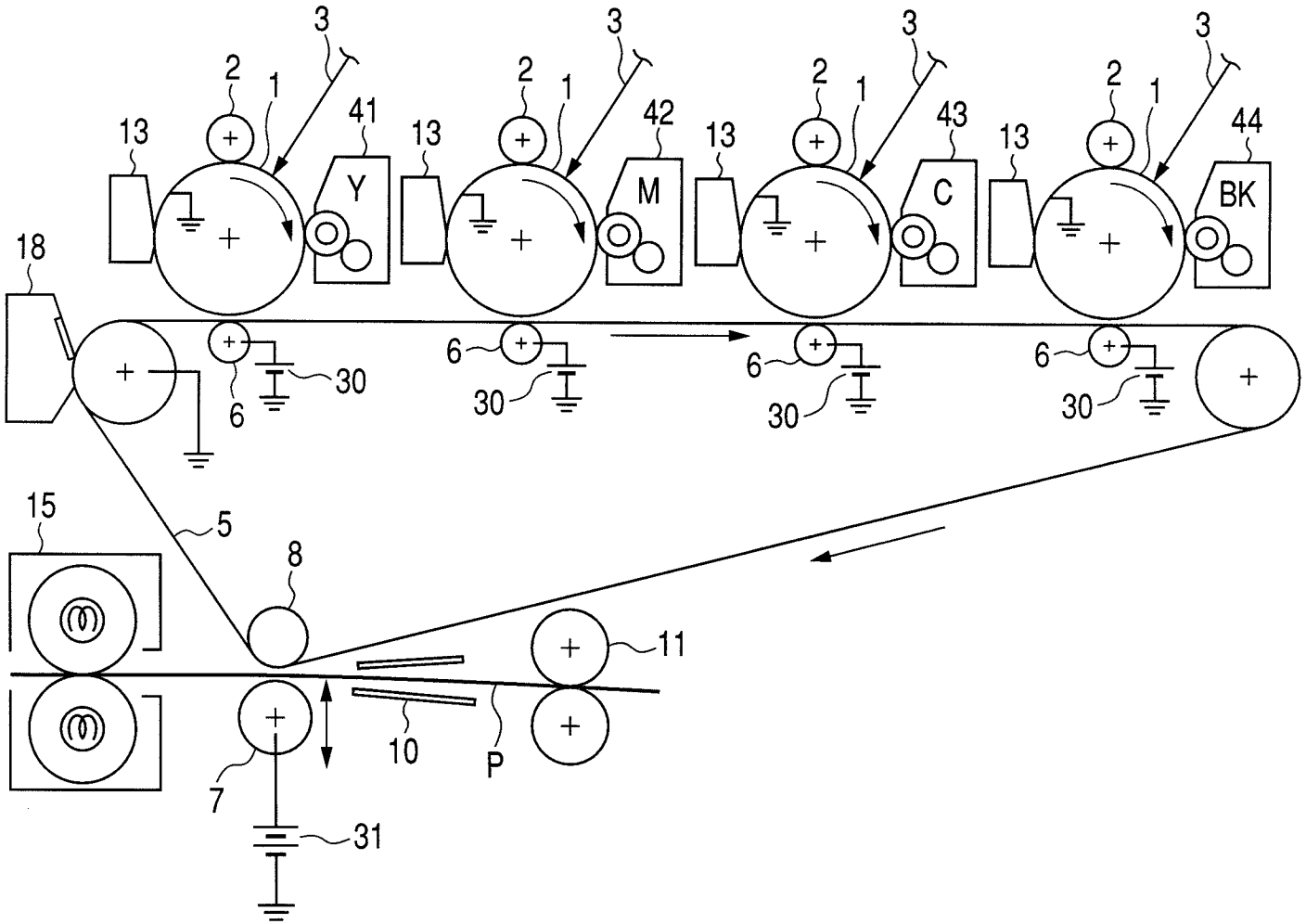
FIG. 4 is a schematic view of another full-color image forming apparatus.

In this Example 23, the image forming apparatus as shown in FIG. 4 was used to form full-color images to make image evaluation. The apparatus shown in FIG. 4 is a color laser beam printer making use of an electrophotographic process of a non-magnetic one-component contact developing system having an intermediate transfer belt. Stated specifically, it has four developing process cartridges respectively having cyan, yellow, magenta and black, four-color toners, in which electrostatic latent images are developed by the use of these toners. Then, toner images formed by development are sequentially transferred onto the intermediate transfer belt and unfixed images are superimposed thereon, which are thereafter one time secondarily transferred to the transfer material by means of a secondary transfer assembly, and further the unfixed images are fixed to the transfer material. Here, as each developing process cartridge, the cartridge set up as shown in FIG. 2 was used, which is of a non-magnetic one-component contact developing system. As the toners, the toners (23) to (26) were used.

Further, the process cartridges and the apparatus main body were set in the following way.

(a) The toner carrying members for the four colors all were so set as to be driven at a peripheral speed of 150% in the forward direction, with respect to the peripheral speed of the rotation of the photosensitive members.

(b) A blade (thickness: 0.4 mm) made of phosphor bronze was used for the toner coat layer control on each toner carrying member.

(c) The base layer side of each photosensitive member was grounded and the voltage to be applied across each toner carrying member and the photosensitive member at the time of development was fixed at a DC voltage of −350 V.

(d) A DC voltage of 200 V was applied across each toner carrying member and the blade made of phosphor bronze, setting the blade side positive.

(e) The photosensitive members were each so adjusted to have a dark-area potential of −700 V and a light-area potential of −150 V.

(f) The primary transfer voltage applied in each station was set to a voltage of 1,500 V.

(g) The voltage of primary transfer was set to 1,500 V, and the voltage of secondary transfer was set to 1,750 V.

(h) The drive system was converted and the process speed was so controlled that images were reproduced at a speed of 32 sheets/minute in A4-lengthwise paper feed.

Evaluation Conditions

In a low-temperature and low-humidity environment (15° C./10% RH) or in a high-temperature and high-humidity environment (30° C./70% RH), images in horizontal lines which were so adjusted to be 1.0% in image print percentage were reproduced in an intermittent mode. As a manner for intermittent image reproduction, it was performed in such a way that three sheets of paper were fed, then a pause is taken for a time of 5 seconds and, from the state the process operation was completely stopped, sheets of paper were again fed. Images formed were evaluated at the running initial stage (10 to 50 sheets), the running middle stage (10,000 sheets) and the running late stage sheets). Evaluation was made on the same items and according to the same evaluation criteria as those in Example 1.

The results of evaluation are shown in Table 8.

Examples 24

Images were formed in the same way as in Example 23 except that the toners (27) to (30) were used instead. Evaluation on the toners was made in the same way. The results of evaluation are shown in Table 8.

Comparative Example 4

Images were formed in the same way as in Example 23 except that the comparative toners (4) to (7) were used instead. Evaluation on the toners was made in the same way. The results of evaluation are shown in Table 8.

TABLE 8 k: ×1,000

| | 15° C., 10% RH | | | | | | | | | 30° C., 70% RH | | | | | |
|---|---|---|---|---|---|---|---|---|---|---|---|---|---|---|---|
| | Toner melt adhesion | | | Line images | | | Halftone images | | | Image fog | | | Charge contamination | | |
| Toner No. | 50 sh. | 10k sh. | 20k sh. | 50 sh. | 10k sh. | 20k sh. | 50 sh. | 10k sh. | 20k sh. | 50 sh. | 10k sh. | 20k sh. | 50 sh. | 10k sh. | 20k sh. |
| Example 23: | | | | | | | | | | | | | | | |
| 23 | A | A | A | A | A | A | B | A | A | A | A | A | A | A | A |
| 24 | | | | | | | | | | | | | | | |
| 25 | | | | | | | | | | | | | | | |
| 26 | | | | | | | | | | | | | | | |
| Example 24: | | | | | | | | | | | | | | | |
| 27 | A | B | B | A | A | B | A | B | C | B | B | C | A | B | B |
| 28 | | | | | | | | | | | | | | | |
| 29 | | | | | | | | | | | | | | | |
| 30 | | | | | | | | | | | | | | | |
| Comparative Example 4: | | | | | | | | | | | | | | | |
| Cp. 4 | A | B | D | A | A | C | B | B | D | D | E | OUT | B | C | OUT |
| Cp. 5 | | | | | | | | | | | | | | | |
| Cp. 6 | | | | | | | | | | | | | | | |
| Cp. 7 | | | | | | | | | | | | | | | |

In Table 8, OUT indicates that the running test was stopped because of run-out of the toner.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-290732, filed Nov. 8, 2007, and Japanese Patent Application No. 2008-224651, filed Sep. 2, 2008, which are hereby incorporated by reference herein in their entirety.

What is claimed is:

1. A toner comprising:

toner base particles having at least a binder resin and a colorant; and a fatty acid metal salt composition as an external additive, wherein the fatty acid metal salt composition contains a nonionic surface-active agent and a fatty acid metal salt, and wherein the nonionic surface-active agent is in a content of from 11 ppm by mass to 210 ppm by mass in the fatty acid metal salt composition.

2. The toner according to claim 1, wherein the nonionic surface-active agent is an ether.

3. The toner according to claim 1, wherein the nonionic surface-active agent has an HLB value in the range of from 5.0 or more to 15.0 or less.

4. The toner according to claim 1, wherein the nonionic surface-active agent is selected from the group consisting of a polyoxyethylene alkyl ether, a polyalkylene alkyl ether and a polyoxyethylene alkyl phenyl ether.

5. The toner according to claim 1, wherein the metal species in the fatty acid metal salt composition is zinc or calcium.

6. The toner according to claim 1, wherein the fatty acid metal salt composition comprises zinc stearate or calcium stearate.

7. The toner according to claim 1, wherein the fatty acid metal salt composition has a melting point of from 122.0° C. or more to 130.0° C. or less.

8. The toner according to claim 1, wherein the fatty acid metal salt composition has, in its volume-based particle size distribution measured with a laser diffraction/scattering particle size distribution measuring instrument, a volume-based median diameter (D50s) of from 0.15 μm or more to 1.05 μm or less.

9. The toner according to claim 8, wherein the volume-based median diameter (D50s) is from 0.15 μm or more to 0.65 μm or less.

10. The toner according to claim 8, wherein the volume-based median diameter (D50s) is from 0.30 μm or more to 0.60 μm or less.

11. The toner according to claim 1, wherein the fatty acid metal salt composition is in a content of from 0.02 part by mass to 1.00 part by mass based on 100 parts by mass of the toner base particles.

12. The toner according to claim 1, wherein the fatty acid metal salt composition is in a content of from 0.05 part by mass to 0.50 part by mass based on 100 parts by mass of the toner base particles.

13. The toner according to claim 1, wherein the toner is used in a non-magnetic one-component developing system.

14. The toner according to claim 1, wherein the toner base particles are particles produced by polymerizing in an aqueous medium a polymerizable monomer composition containing at least a polymerizable monomer, a release agent and a colorant.

15. An image forming process comprising:

developing an electrostatic latent image held on a toner carrying member to render the electrostatic latent image visible, by using the toner according to claim 1;

transferring to a recording medium a toner image rendered visible by the use of the toner; and fixing the toner image transferred to the recording medium.

* * * * *